US011136775B2

(12) United States Patent
Borg et al.

(10) Patent No.: US 11,136,775 B2
(45) **Date of Patent: *Oct. 5, 2021**

(54) AUTOMATIC SWIMMING POOL CLEANERS OPTIONALLY PROVIDING DUAL FILTRATION

(71) Applicant: Zodiac Pool Systems LLC, Carlsbad, CA (US)

(72) Inventors: Dustin Borg, Poway, CA (US); Fletcher Ewing, San Marcos, CA (US); Hendrikus Johannes van der Meijden, Glen Austin (ZA); Michael Edward Moore, Johannesburg (ZA)

(73) Assignee: ZODIAC POOL SYSTEMS LLC, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/904,826

(22) Filed: Jun. 18, 2020

(65) Prior Publication Data

US 2020/0318372 A1 Oct. 8, 2020

Related U.S. Application Data

(63) Continuation of application No. 16/225,203, filed on Dec. 19, 2018, now Pat. No. 10,724,265.

(60) Provisional application No. 62/613,536, filed on Jan. 4, 2018.

(51) Int. Cl.
*E04H 4/16* (2006.01)
*E04H 4/12* (2006.01)

(52) U.S. Cl.
CPC ..... *E04H 4/1654* (2013.01); *E04H 4/1672* (2013.01); *E04H 4/1218* (2013.01)

(58) Field of Classification Search
CPC .... E04H 4/1654; E04H 4/1672; E04H 4/1218
USPC ..... 210/167.16, 167.17, 232, 416.2; 15/1.7
See application file for complete search history.

(56) References Cited

U.S. PATENT DOCUMENTS

| | | | | |
|---|---|---|---|---|
| 3,932,281 | A | 1/1976 | Pansini | |
| 5,269,913 | A * | 12/1993 | Atkins | B01D 29/94 210/136 |
| 6,090,219 | A | 7/2000 | Henkin et al. | |
| 6,706,175 | B1 | 3/2004 | Rief et al. | |
| 6,942,790 | B1 | 9/2005 | Dolton | |

(Continued)

FOREIGN PATENT DOCUMENTS

| | | |
|---|---|---|
| EP | 2706170 | 3/2014 |
| WO | 2007149411 | 12/2007 |

OTHER PUBLICATIONS

U.S. Appl. No. 16/225,203, Non-Final Office Action dated Nov. 27, 2019, 11 pages.

(Continued)

*Primary Examiner* — Fred Prince
(74) *Attorney, Agent, or Firm* — Kilpatrick Townsend & Stockton LLP; Dean W. Russell

(57) ABSTRACT

Automatic swimming pool cleaners and components thereof are described. The cleaners may provide dual filtration of debris suspended in water of pools as well as a fluid path allowing some water to by-pass one of the two filters. They also may include any of all components such as multi-section inlet tubes, Venturi jets, nozzles exhausting water onto rotatable vanes, brushes, downforce turbines, and mechanisms for adjusting water flow through thrust jets or sweep tails.

3 Claims, 44 Drawing Sheets

(56) References Cited

U.S. PATENT DOCUMENTS

| | | | |
|---|---|---|---|
| 10,724,265 | B2 | 7/2020 | Borg et al. |
| 2010/0065482 | A1 | 3/2010 | Sumonthee |
| 2013/0146106 | A1 | 6/2013 | Erlich |
| 2014/0042063 | A1 | 2/2014 | Rief |
| 2015/0191926 | A1 | 7/2015 | Tavor et al. |
| 2015/0337555 | A1 | 11/2015 | Hui et al. |
| 2017/0096828 | A1 | 4/2017 | Moore et al. |

OTHER PUBLICATIONS

U.S. Appl. No. 16/225,203, Notice of Allowance dated Apr. 6, 2020, 7 pages.
International Application No. PCT/US2018/066396, International Preliminary Report on Patentability dated Jul. 16, 2020, 13 pages.
International Application No. PCT/US2018/066396, International Search Report and Written Opinion dated May 7, 2019, 18 pages.
International Application No. PCT/US2018/066396, Invitation to Pay Additional Fees and, Where Applicable, Protest Fee dated Mar. 6, 2019, 13 pages.

* cited by examiner

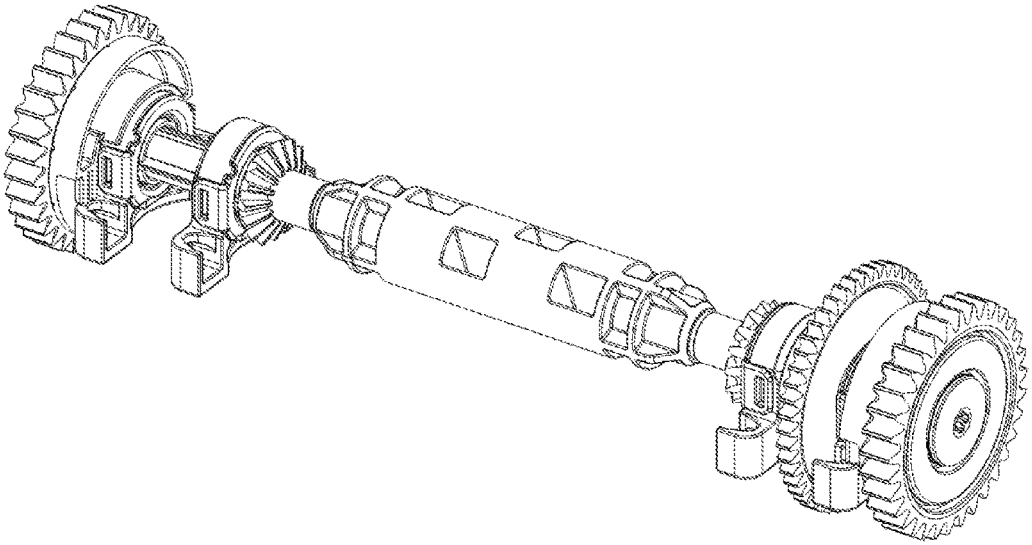
Fig. 12
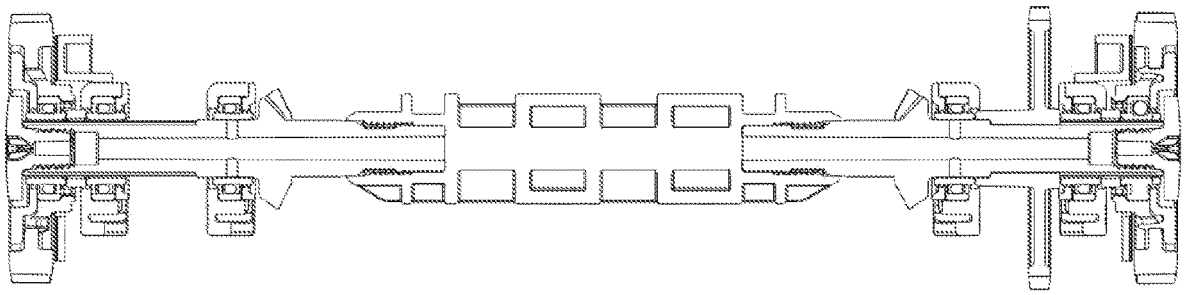

AUTOMATIC SWIMMING POOL CLEANERS OPTIONALLY PROVIDING DUAL FILTRATION

CROSS-REFERENCE TO RELATED APPLICATION

This application is a continuation of allowed U.S. patent application Ser. No. 16/225,203, filed Dec. 19, 2018 (the "Allowed Application"), which claims the benefit of and priority to U.S. Provisional Patent Application Ser. No. 62/613,536, filed Jan. 4, 2018, and having the same title as appears above (the "Provisional Application"), the entire contents of both of which Allowed Application and Provisional Application are hereby incorporated herein by this reference.

FIELD OF THE INVENTION

This invention relates to cleaners of water-containing vessels such as swimming pools and spas and more particularly, although not necessarily exclusively, to automatic pool cleaners (APCs) optionally providing separate filtration of large and small debris within the vessels as well as capability of by-passing a filter of small debris.

BACKGROUND OF THE INVENTION

Commonly-owned U.S. Patent Application Publication No. 2017/0096828 of Moore, et al., details filtration aspects of certain APCs. Cleaners described in the Moore application may be hydraulic, pressure-side APCs, in that they may communicate with outlets ("pressure sides") of, typically, remotely located water-circulation pumps. These cleaners also may include canisters as debris filters, with the canisters being "designed so as not to be wholly internal to" bodies of the APCs "yet not materially increase hydraulic drag as" the APCs move autonomously within swimming pools. See Moore, p. 1, ¶ 0018.

U.S. Patent Application Publication No. 2015/0337555 of Hui, et al., discloses a manually-operated (and thus not automatic) pool cleaner having a handle to allow a person to move the cleaner within a pool. The manual cleaner may include both a "mesh filter" for removing larger pieces of debris and a "filter bag" for removing finer pieces of debris. As described in the Hui application, pool water flows through the mesh filter and then through the filter bag to remove, consecutively, larger and finer debris. See Hui, p. 7, ¶ 0101.

Neither the Moore application nor the Hui application addresses by-passing part of a dual-stage filtration system. Neither application discusses a possibility of having a permanent by-pass, in which a portion of the pool water entering the cleaner always by-passes the small-debris filter, and neither contemplates making a small-debris filtration stage optional while retaining a large-debris filtration stage. These and other issues remain to be resolved in connection with APCs.

SUMMARY OF THE INVENTION

The present invention resolves issues such as these. In some embodiments of the innovative APCs, one (inner) filter of a dual-filtration system may be positioned, or nested, at least partially within another (outer) filter. However, openings or a gap (or both) may be present such that some water by-passes the finer outer filter yet encounters the coarser inner filter. This by-pass may function to reduce the back-pressure created by the filtration system when the outer filter is heavily loaded.

Versions of the present invention also contemplate the outer filter being optional. Accordingly, it may be removable from the inner filter, with the inner filter then standing alone. In some embodiments the inner filter may snap into the outer filter when both are to be used together, although other attachment mechanisms may be employed instead.

Filtration systems of the invention preferably are of the canister type, including mesh supported by generally rigid frames. At least part of the canister may form a top, roof, or other part of the body of the cleaner; it further may, if desired, include a transparent section allowing viewing of debris therein. Some filters additionally may contain multiple pockets so as to increase the surface area of the mesh.

The canisters may be created in at least two parts, with at least one part being movable relative to the other(s) for dumping of collected debris and cleaning. They may incorporate part of an entrance tube for debris-laden water, with the tube also serving as a handle for grasping a canister. The canister may be fitted into a cavity within the body of the cleaner and snap, or otherwise latch, in place. In at least some embodiments of the invention, the canister may be lowered linearly into the cavity for latching but, after unlatching, may be rotated out of the cavity.

Cleaners embraced within the present invention may include inlet tubes having multiple sections. A first section, for example, may be generally vertically oriented (when the cleaner is upright) and open at the bottom of the cleaner. Communicating therewith may be a second section oriented substantially vertically but curved in nature toward the nominal rear of the cleaner. In this second section may be included Venturi jets for drawing debris-laden water into the tube.

A third section of the inlet tube may be formed in the upper part of the body not only to continue the fluid-flow path, but also to isolate the debris-laden water from filtered water used to drive the cleaner. A fourth section of the tube may be positioned in a lower part of the canister and serve as the handle noted above. Finally, a fifth section of the inlet tube may extend into an upper part of the canister and, if desired, be transparent to show debris-laden water through the transparent section of the canister. Variations of this tube structure may, of course, be utilized instead.

After passing through the mesh of the canister, cleaned water may be exhausted from the cleaner in any suitable manner. Presently preferred is that the water exit the canister into the cavity of the body. Thereafter, it may be exhausted from the rear of the cleaner—through a low-restriction region similar in concept to that of the Moore application or otherwise—into the swimming pool.

APCs of the present invention may include wheels or other motive elements driven hydraulically. Pressurized water entering a cleaner from an outlet of a water-circulation pump may be jetted through nozzles within the body of the cleaner onto rotatable vanes. This internal jetting causes the vanes to rotate, in turn rotating at least one drive shaft. Rotational motion of the drive shaft is converted to movement of the motive elements in any suitable way, with a preferred mechanism including miter gears integrally formed with the shaft and configured to engage teeth of the motive elements either directly or indirectly.

In some versions of the innovative drive system, multiple nozzles are arrayed about the circumference of the rotatable vanes. One presently-preferred version includes three nozzles spaced about the circumference of the vanes. This version also contains three water exits from the drive system, again spaced about the circumference of the vanes and arcuately offset from the nozzles. Water jetted by a first nozzle thus engages any particular vane through an arc and exits prior to that vane being engaged by water jetted by a second nozzle. Similarly, water jetted by the second nozzle engages the vane through an arc and exits prior to the vane being engaged by water jetted by a third nozzle.

Cleaners described herein also may include rollers, or brushes, extending from (nominally) forward sections of their bodies. Flexible blades may be spaced about the exterior of a generally cylindrical core to form the brushes, which may rotate to facilitate scrubbing of a to-be-cleaned surface. The brushes may connect directly or indirectly to the drive system of a cleaner; presently preferred is that they connect to motive elements driven by the drive system. Adjacent outer ends of the brushes may be rotating scrubbers which also function as cushioned bumpers to protect pool surfaces that otherwise might be damaged by rigid plastic portions of the cleaners.

The present innovations also contemplate use of downforce scrubbers or turbines with pressure-side cleaners. Such scrubbers are disclosed and illustrated in commonly-owned U.S. Pat. No. 9,611,668 to van der Meijden, et al. However, in embodiments of the present cleaners, the downforce turbines may be offset (and even potentially isolated) from a water inlet and no longer materially "push" debris toward the inlet.

Consistent with some other pressure-side hydraulic cleaners, versions of the present invention may include hydraulic accessories such as either or both of at least one thrust jet to cause a bias in movement or one or more tail sweeps—i.e. hoses attached at rear regions of the cleaners and receiving pressurized water so as to cause generally serpentine (or other similar) movement thereof. This movement of the sweep tail tends to draw debris into suspension in the pool water, ultimately facilitating its being captured by the cleaner. Embodiments of the present APCs may include a mechanism for adjusting flow through the hydraulic accessories, with some versions including a slot into which a tool may be inserted to rotate a valve communicating with the hydraulic accessory.

It thus is an optional, non-exclusive object of the present invention to provide novel cleaning equipment for water-containing vessels such as swimming pools and spas.

It is also an optional, non-exclusive object of the present invention to provide APCs supplying dual filtration when desired.

It is another optional, non-exclusive object of the present invention to provide APCs including a finer filter into which a coarser filter may be fitted, with openings or gaps allowing some water to by-pass the finer filter.

It is a further optional, non-exclusive object of the present invention to provide APCs in which the finer filter is removable from the coarser filter, allowing the cleaners to operate with only the coarser filtration when desired.

It is, moreover, an optional, non-exclusive object of the present invention to provide pressure-side APCs in which the filtration is in canister, rather than bag, form.

It is an additional optional, non-exclusive object of the present invention to provide APCs whose filter canisters have multiple parts and may incorporate part of an entrance tube for debris-laden water.

It is yet another optional, non-exclusive object of the present invention to provide APCs having entrance tubes with multiple sections, one including Venturi jets, one also functioning as a handle for a canister, and one being transparent to facilitate viewing of debris entering the canister.

It is too an optional, non-exclusive object of the present invention to provide pressure-side APCs with drive systems comprising multiple nozzles arrayed about the circumference of a set of rotatable vanes.

It is also an optional, non-exclusive object of the present invention to provide APCs whose drive systems include multiple water exits, one associated with each nozzle.

It is another optional, non-exclusive object of the present invention to provide APCs having rotating downforce turbines and brushes.

It is, furthermore, an optional, non-exclusive object of the present invention to provide APCs having hydraulic accessories and mechanisms for adjusting water flow through the accessories.

Other objects, features, and advantages of the present invention will be apparent to those skilled in the relevant art with reference to the remaining text and the drawings of this application.

BRIEF DESCRIPTION OF THE DRAWINGS

FIG. 12 is a perspective view of an idler assembly for use as part of the cleaner of FIG. 1.

DETAILED DESCRIPTION

Figure 1:
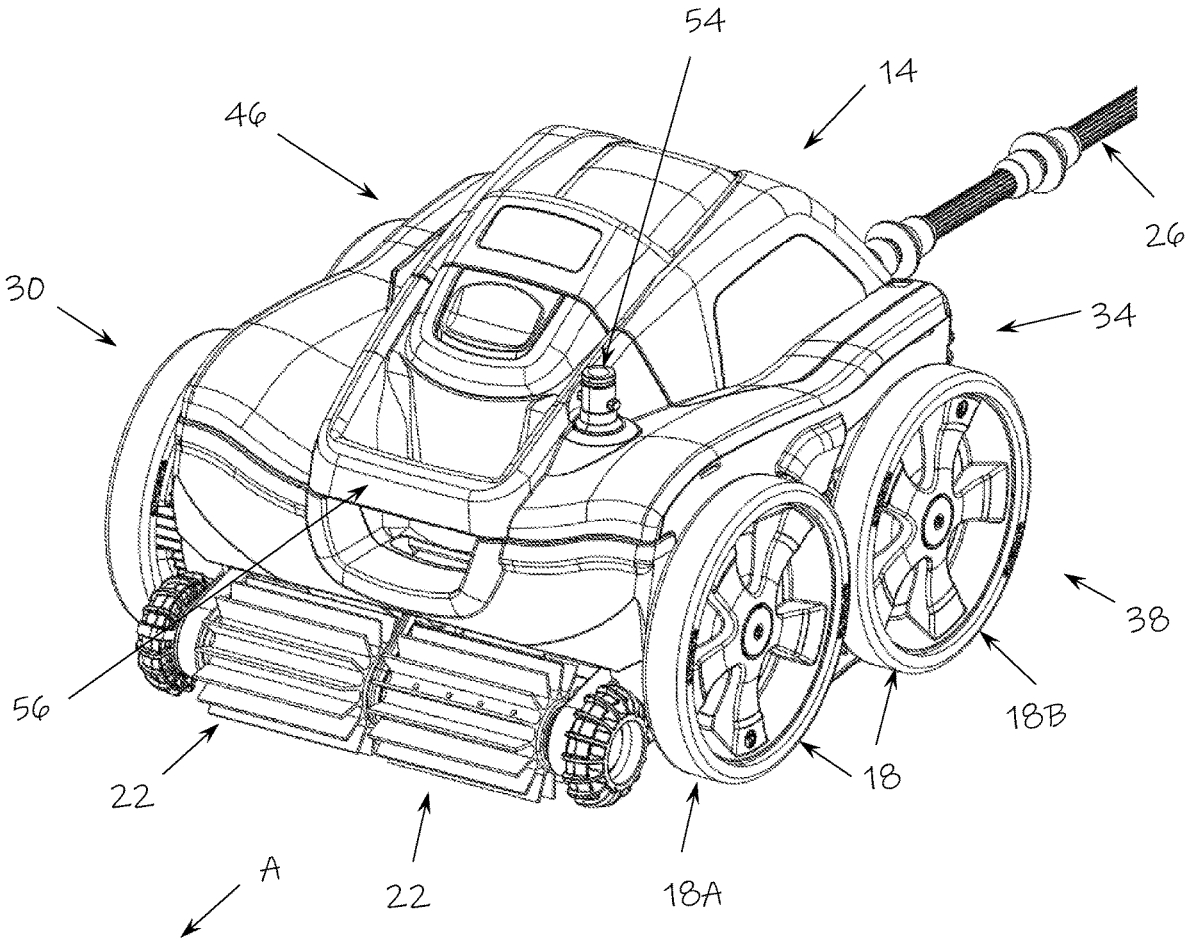
FIG. 1 is a perspective view of a cleaner encompassed within the present invention showing principally the (nominal) front and left side thereof.
Figure 2:
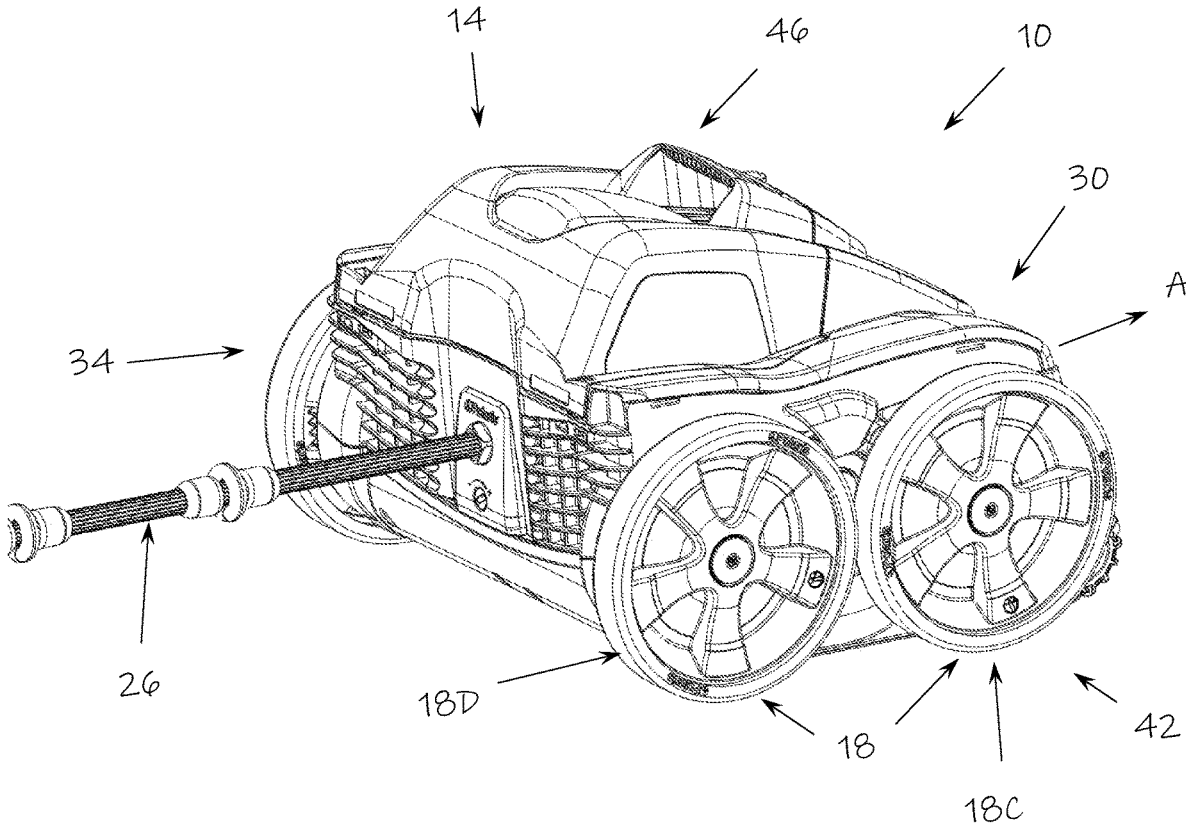
FIG. 2 is a perspective view of the cleaner of FIG. 1 showing principally the (nominal) rear and right side thereof.

FIGS. 1-2 depict an exemplary cleaner 10 consistent with the present invention. Cleaner 10 may be an APC capable of autonomous movement with a water-containing vessel such as a swimming pool or spa. In particular, cleaner 10 may be a pressure-side hydraulic APC, although some or all concepts described herein may be applicable to both suction-side hydraulic and electric (robotic) APCs as well.

Also illustrated in FIGS. 1-2 are components of cleaner 10 including body 14, motive elements 18, brushes 22, and sweep tail 26. In use, body 14 normally will travel in direction A along a to-be-cleaned surface of a pool or spa when in the upright position depicted. Body 14 thus nominally may comprise front 30, rear 34, left side 38, right side 42, top 46, and bottom 50 (see FIGS. 8-9). Inlet 54 is configured to receive pressurized water (as from an outlet of a pump); as depicted, it extends upward from top 46 in the region of front 30, although persons skilled in the art will recognize that the inlet 54 may be positioned elsewhere in connection with cleaner 10. Body 14 optionally may include handle 56 as well.

Motive elements 18 preferably comprise wheels 18A-D, with two such wheels 18A-B positioned on left side 38 and two more wheels 18C-D positioned on right side 42. Wheels 18A and 18C preferably are driven, although in some embodiments wheels 18B and 18D may be driven as well. Alternatively, tracks (or combinations of tracks and wheels) may be employed as some or all motive elements 18.

Brushes 22 may extend nominally forward of body 14 in the region of front 30 and bottom 50. They hence may function as the leading edge of cleaner 10 when the cleaner 10 is travelling in direction A. Sweep tail 26, by contrast, may extend nominally rearward of body 14 in the region of rear 34, functioning as the trailing portion of cleaner 10.

FIGS. 3-6 show filter assembly or canister 58 and its constituent parts. In most cases canister 58 may comprise first and second filters 62 and 66, respectively, each preferably including mesh 67 supported by a molded plastic frame 68. Each of filters 62 and 66 effectively forms a basket into which debris may be deposited. First filter 62 may be referred to as a "coarser" filter, advantageously utilizing mesh (made of flexible plastic or other material) whose openings approximate six hundred (600) microns. Second filter 66 may be a "finer" filter with mesh openings of approximately two hundred (200) microns. Other size meshes may be used instead as appropriate or desired, however, as neither filter 62 or 66 is restricted to including any particular mesh 67.

Each of filters 62 and 66 beneficially may (but need not necessarily) be divided into at least two "pockets" 70 for receiving debris. Dividing filters 62 and 66 in this manner increases the amount of mesh used and thus the overall surface area available for filtering debris. First filter 62 additionally may include fourth section 74 of inlet tube 78 (see FIGS. 8-9), with the fourth section 74 available as a handle for grasping the first filter 62.

Figure 4:
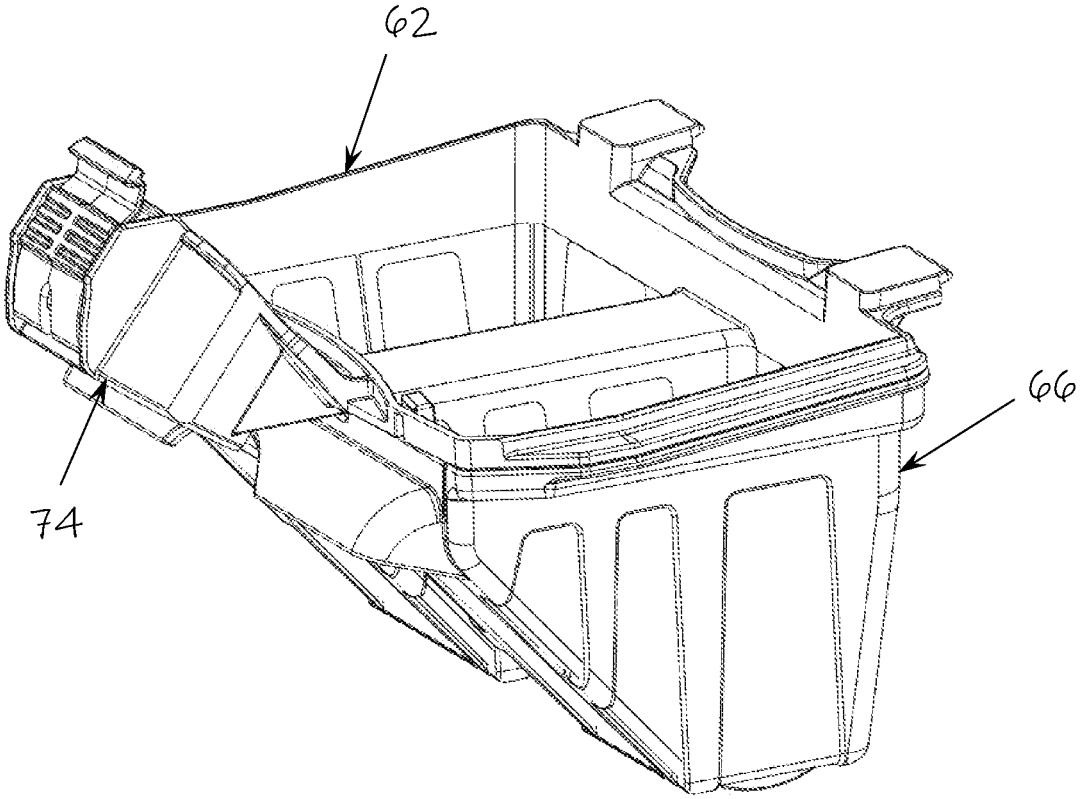
FIG. 4 is a perspective view of the two filters of FIG. 3 showing one filter nested, or fitted, into the other to form a (nominal) lower portion of a filter canister.
Figure 5:
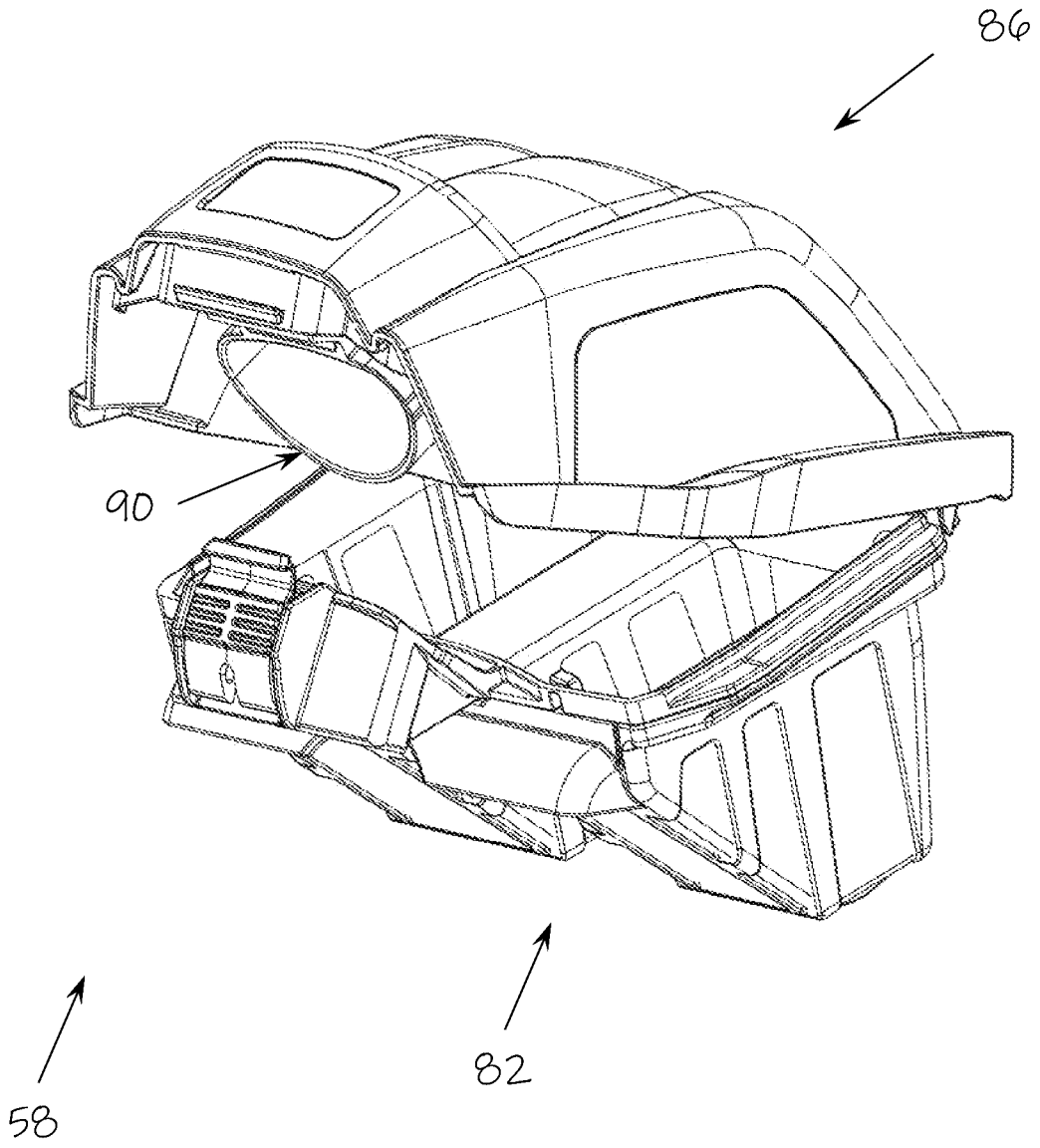
FIG. 5 is a perspective view of the lower portion of the canister of FIG. 4 together with an upper portion moveable with respect thereto, the combination of the lower and upper portions forming the canister.

As shown especially in FIG. 4, first filter 62 may fit into second filter 66, with the pockets 70 of each filter aligned. Generally, therefore, fluid entering first filter 62 will exit its pockets 70 and flow into corresponding pockets 70 of second filter 66. However, some versions of filters 62 and 66 intentionally may be designed so that not all fluid entering first filter 62 will flow through mesh 67 of second filter 66. Instead, second filter 66 may contain one or more openings 71 in its frame 68 allowing water to exit the second filter 66 without passing through its mesh 67, effectively by-passing filtration otherwise provided by the second filter 66. If present, one or more openings 72 may function similarly. Size and number of the openings 71 or 72 may vary as desired to balance effectiveness of cleaner 10 when second filter 66 is heavily loaded versus when it is not heavily loaded.

When present, therefore, first filter 62 and second filter 66 may provide dual-stage filtration of debris-laden water of a swimming pool or spa. The coarser first filter 62 will remove larger debris from the water, while the finer second filter 66 will remove smaller debris. As noted above, some debris-laden water preferably will enter first filter 62 but exit it in a manner by-passing mesh 67 of second filter 66 (hence being subject only to one-stage filtering). Conceivably, however, this by-pass could be omitted from some versions of canister 58.

Figure 3:
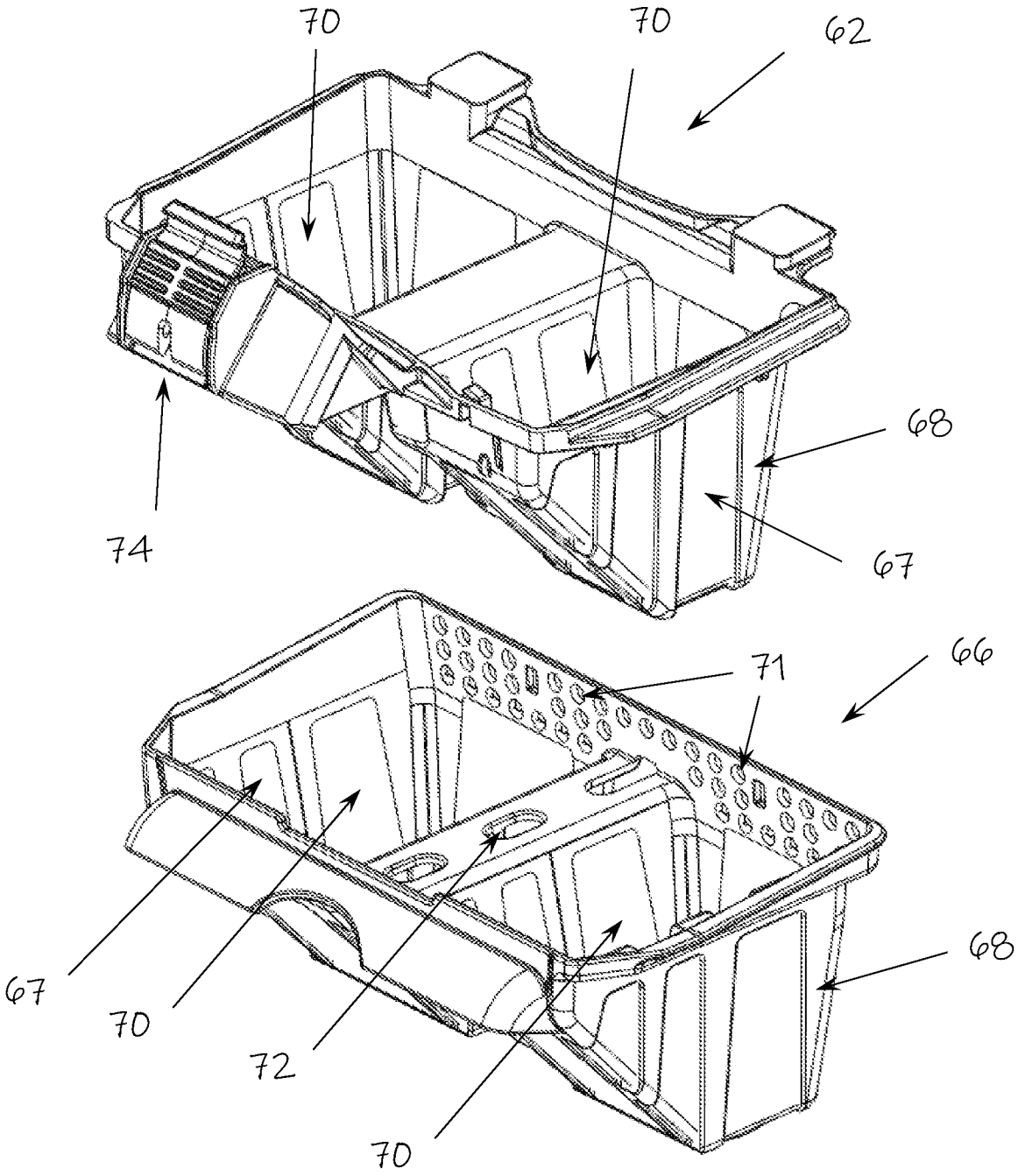
FIG. 3 is an exploded perspective view of two filters for use as part of the cleaner of FIG. 1.

Contemplated by many embodiments of the invention is that canister 58 always will include the "coarser" first filter 62 (in which fourth section 74 of inlet tube 78 is present). Second filter 66 need not necessarily be used as part of canister 58, however, when its "finer" filtration is unneeded or undesired. Thus, even after first filter 62 is fitted into second filter 66 (as shown in FIG. 4), it may be separated therefrom (as shown in FIG. 3) both in the event second filter 66 is not to be deployed further or if the second filter 66 needs to be cleaned of fine debris.

Figure 6:
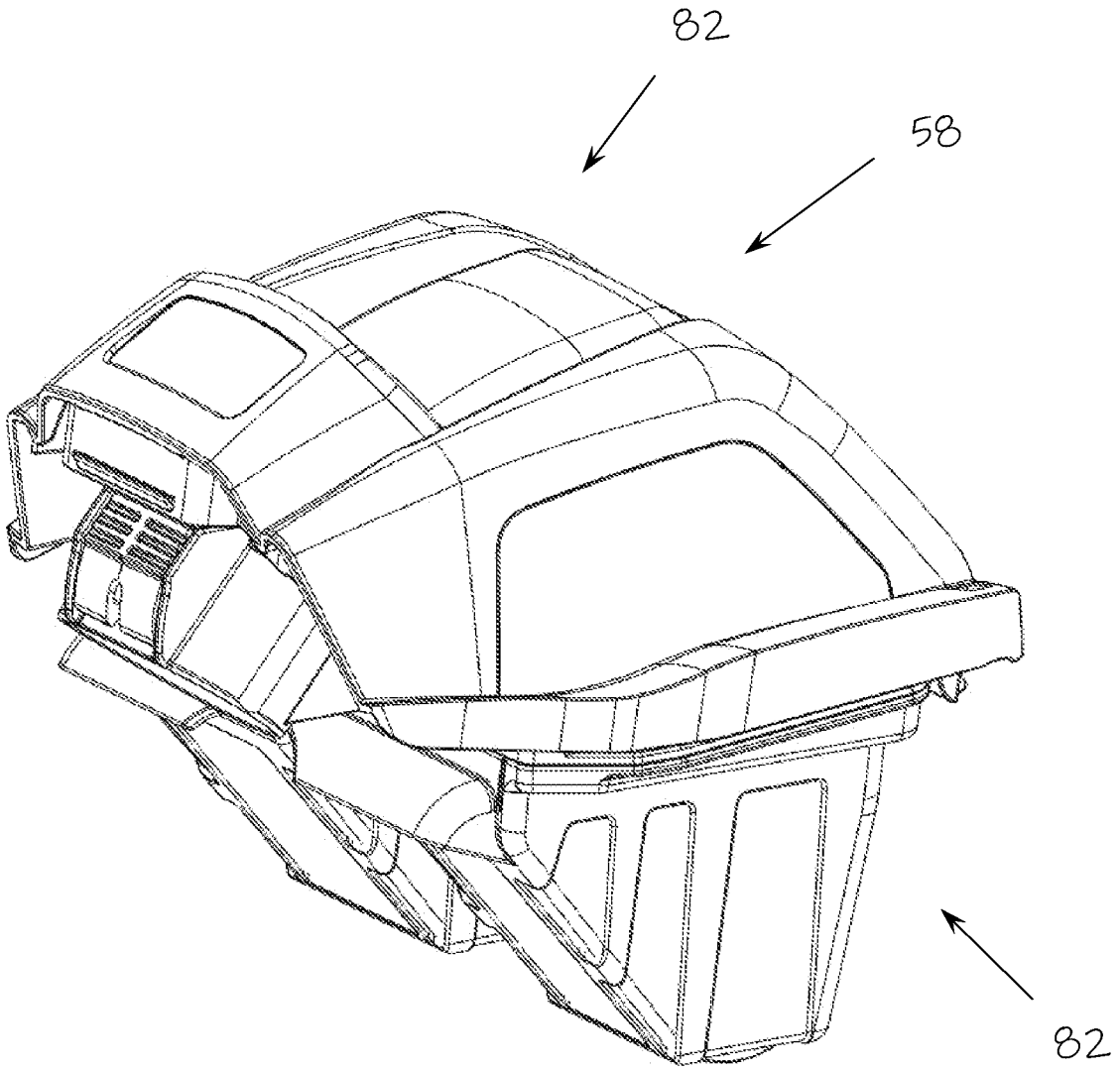
FIG. 6 is a perspective view of the filter canister of FIG. 5.

Either first filter 62 (when used alone) or the combined first and second filters 62 and 66 (when used together) form lower part 82 of canister 58. The canister 58 also includes upper part 86 which may be connected to lower part 82. Upper part 86 may incorporate fifth section 90 of inlet tube 78, which section 90 is configured to align in fluid communication with fourth section 74 when canister 58 is closed as shown in FIG. 6. Some or all of upper part 86 may be transparent (clear) to permit viewing of at least some debris captured by canister 58.

Figure 7:
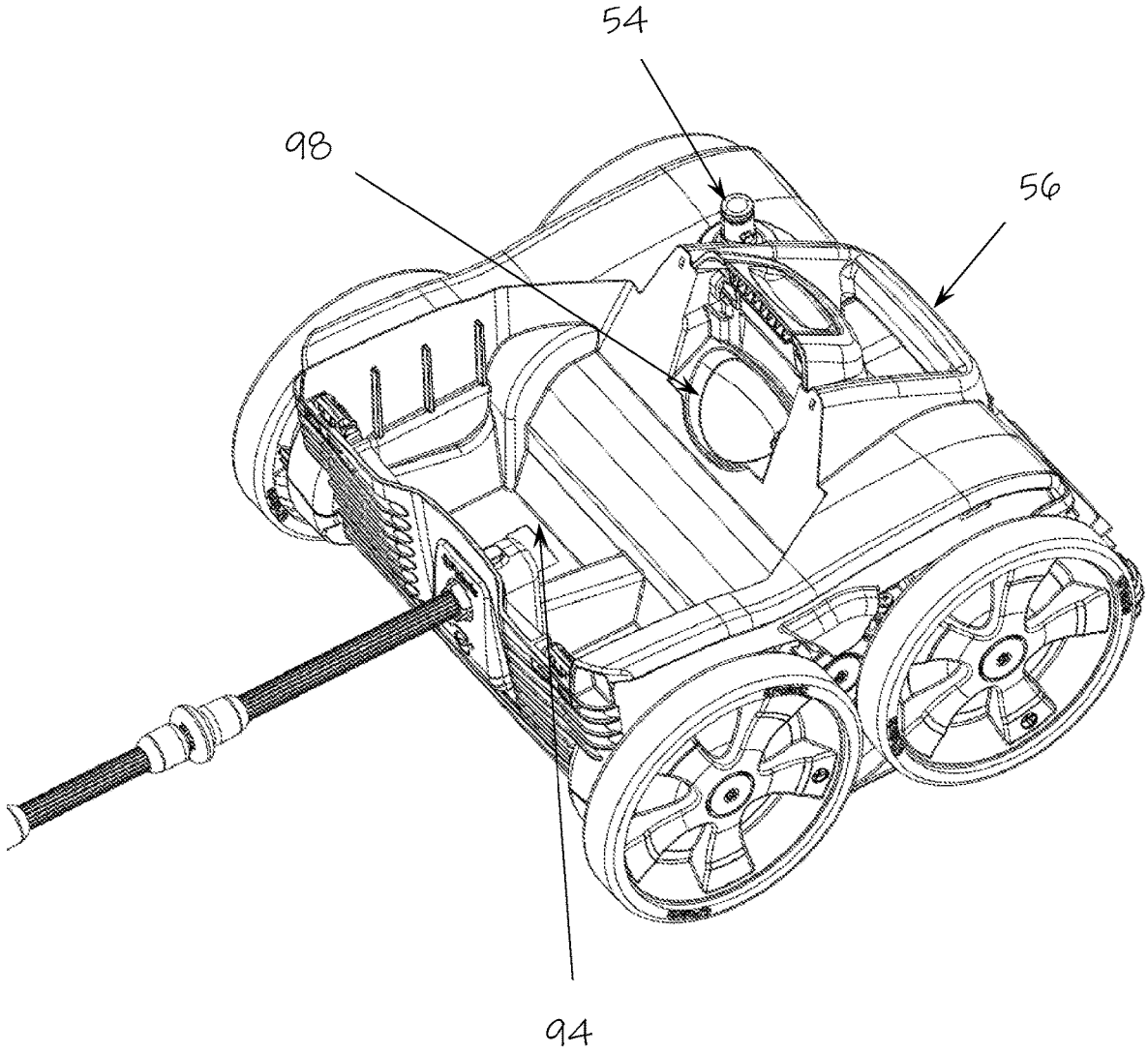
FIG. 7 is a perspective view of part of the cleaner of FIG. 1 illustrating principally a cavity in a body of the cleaner into which the canister may be fitted.

In use, canister 58 may be fitted into cavity 94 of body 14 (see FIG. 7). As so fitted, aligned fourth and fifth sections 74 and 90 also are aligned, and communicate, with third section 98 of inlet tube 78. Canister 58 additionally is isolated from inlet 54 (which receives filtered, pressurized water for the drive system) so as to avoid material contamination of the pressurized drive water by the debris-laden water passing through the canister 58.

Figure 8:
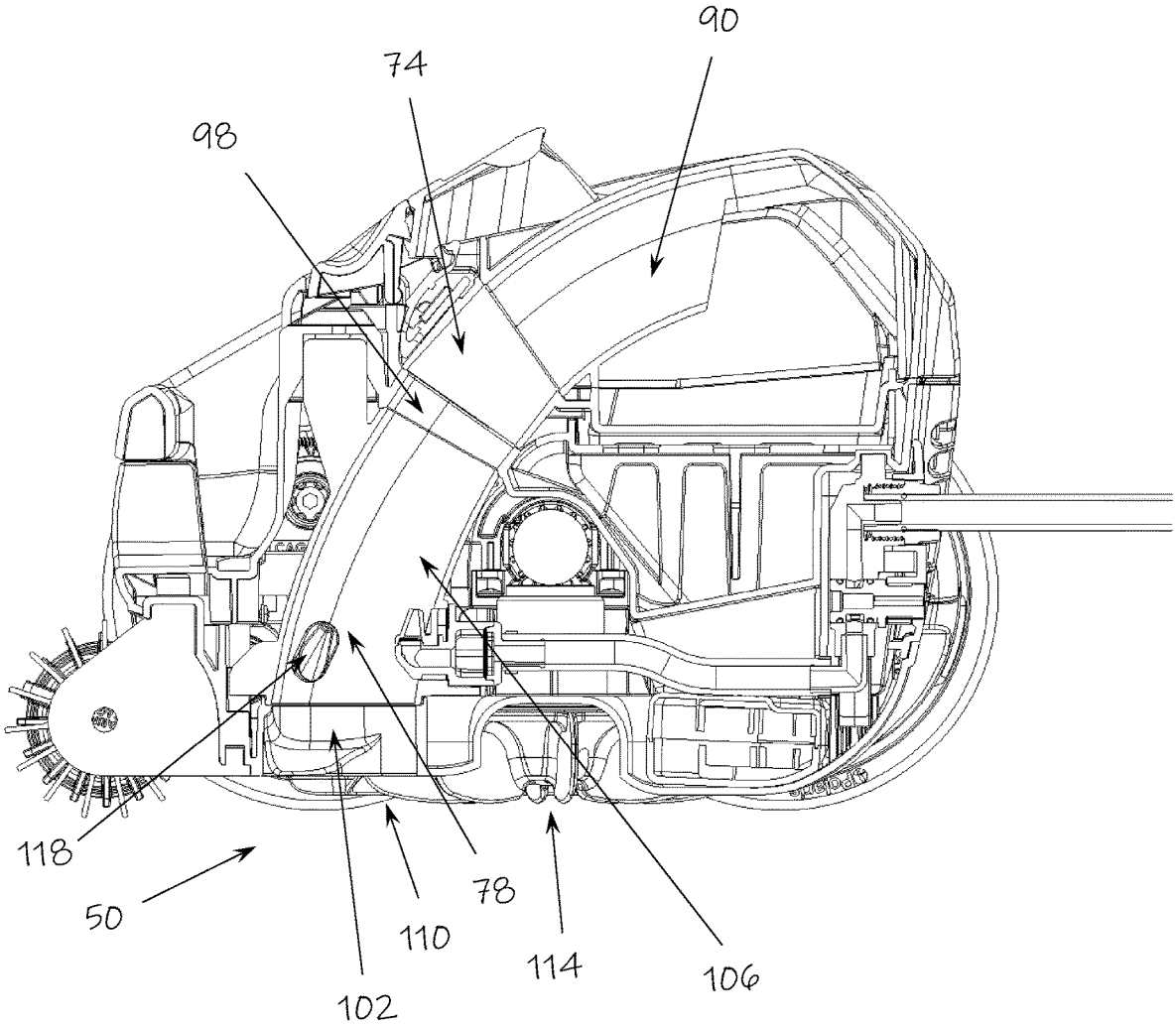
FIG. 8 is a first sectional view of the cleaner of FIG. 1 showing principally a multi-section inlet tube thereof.
Figure 9:
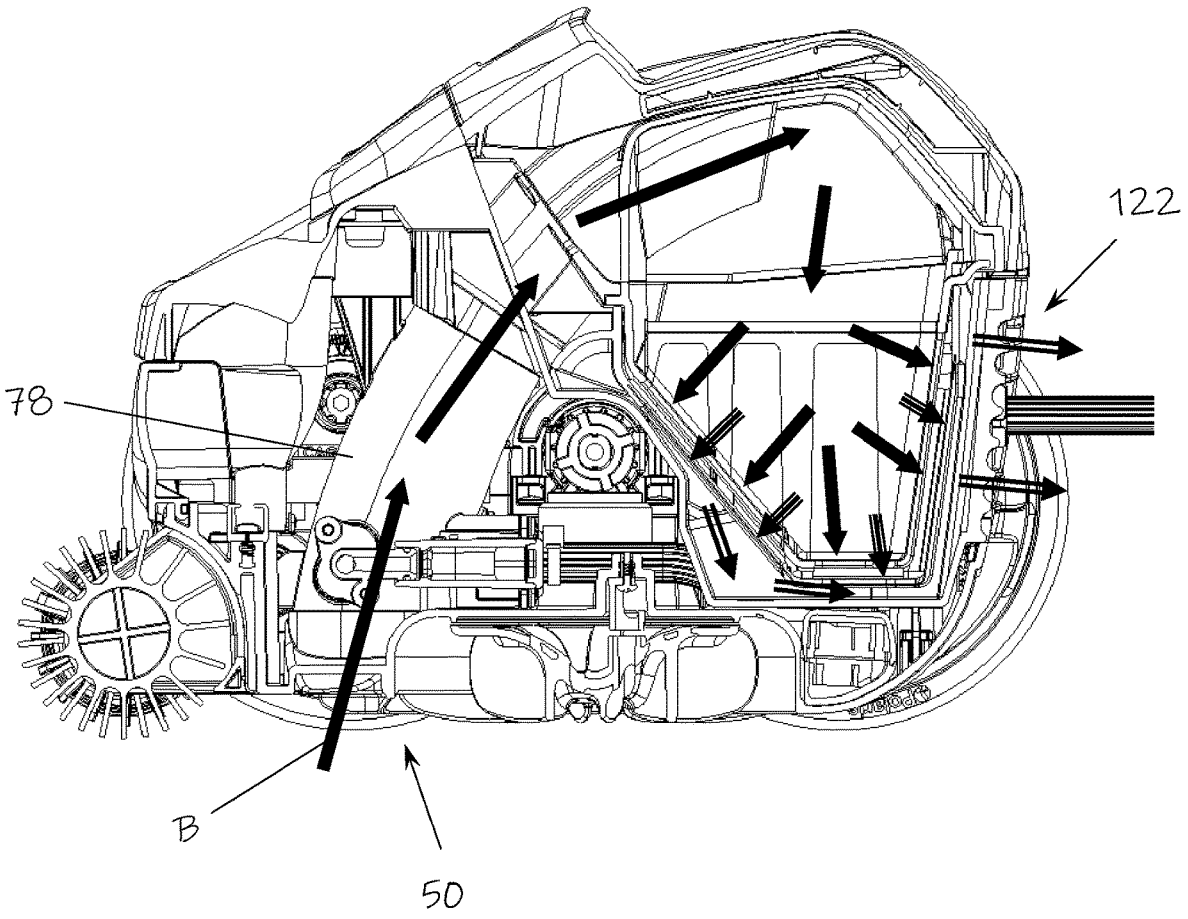
FIG. 9 is a second sectional view of the cleaner of FIG. 1 showing principally flow of debris-laden water into the cleaner and through the filter canister.

The sectional views of FIGS. 8-9 provide additional illustration of, e.g., inlet tube 78. Beyond third section 98, fourth section 74, and fifth section 90 discussed above, inlet tube 78 may include first section 102 and second section 106. When cleaner 10 is in use, these (first through fifth) sections are connected together in order to function as a unitary structure to communicate debris-laden pool water from cleaning inlet 110 to filters of canister 58 for filtering.

First section 102 preferably is positioned closer to front 30 than to rear 34 and laterally in a central part of body 14. First section 102 also may be positioned nominally forward of downforce turbines 114 and connect to second section 106. It further may be molded as part of body 14 or a separate component connected thereto.

Water entering first section 102 travels nominally upward into second section 106. Like first section 102, second section 106 is generally vertically oriented. Second section 106, however, may be curved if desired so as to slant toward rear 34, where canister 58 is housed in cavity 94. Second section 106 also may include one or more Venturi nozzles or jets 118 (one of which is visible in FIG. 8 through a cut-away portion of the second section 106) designed to receive pressurized water via inlet 54 and jet it upward further into tube 78, thereby facilitating debris-laden water being drawn into first section 102.

Third section 98 may be formed as part of body 14 if desired. As noted above, fourth section 74 may be part of first filter 62 and upper part 86 may include fifth section 90. Although sectioning inlet tube 78 in this manner has multiple benefits, inlet tube 78 need not necessarily be sectioned or, if sectioned, need not necessarily be sectioned in the manner described herein.

Arrow sequence B (FIG. 9) generally depicts flow of debris-laden water through cleaner 10. This water is evacuated from a pool into cleaning inlet 110. It then may travel through inlet tube 78, emptying within first filter 62. As the debris-laden water passes through first filter 62, larger debris is stopped by the coarser mesh and retained within its pockets 70. Assuming second filter 66 is present, much of the water exiting first filter 62 will pass into the second filter 66, whose finer mesh will stop smaller debris. Thereafter this twice-filtered water will enter cavity 94 and then exhaust mostly at rear 34 through, preferably, openings of low-restriction region 122.

Some water exiting first filter 62 may by-pass second filter 66, however, and instead immediately enter cavity 94 for exhausting through region 122. Hence, this latter portion of water is only filtered once, by the coarser mesh of filter 62 before intermingling with the remaining twice-filtered water in cavity 94. Always maintaining this by-pass may reduce back-pressure created by the filtration system of canister 58 when second filter 66 is heavily loaded and thus enhance operation of cleaner 10 overall.

Conceivably, though, such a by-pass might be disadvantageous in certain circumstances, so the present invention may encompass apparatus in which no by-pass exists. Nevertheless, continuously diverting a portion of water around second filter 66 is preferred. Also preferred is that the by-pass be sufficiently large as to allow a significant flow of water through the cleaner 10 yet sufficiently small as to maintain a pressure differential across the mesh of second filter 66 to force through the finer mesh screen water that has entered the second filter 66, even in the presence of the by-pass and to maintain fine debris stuck to the fine mesh though water may be flowing past it.

Figure 10:
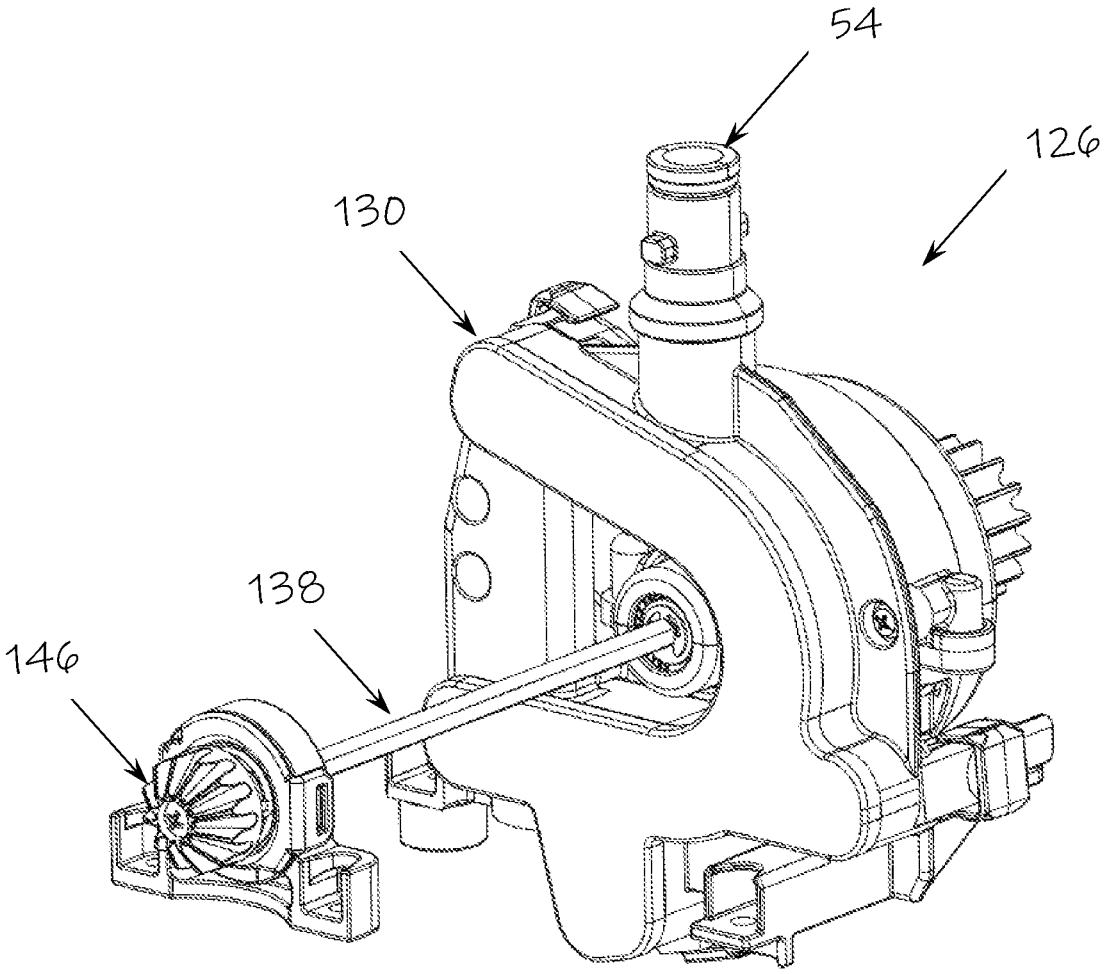
FIG. 10 is a perspective view of components of a drive system for use as part of the cleaner of FIG. 1.
Figure 10A:
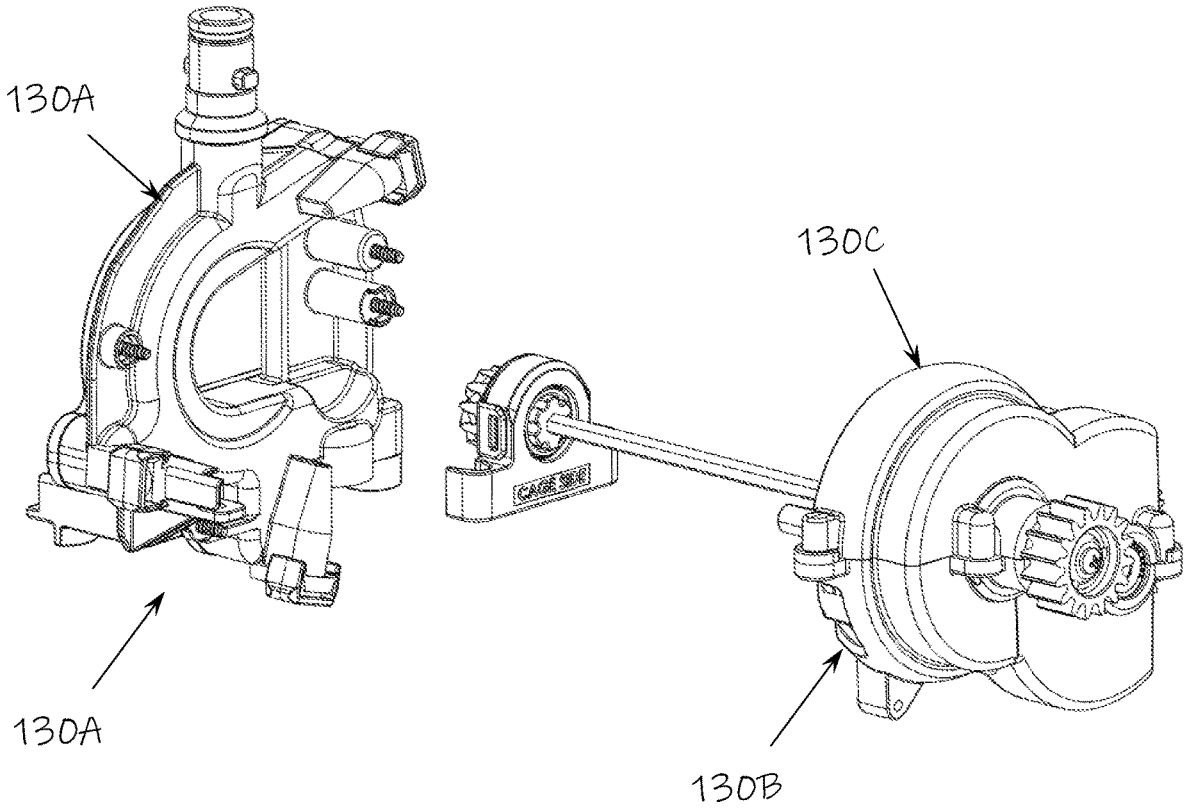
FIG. 10A is a partially exploded view of the components of FIG. 10.
Figure 11:
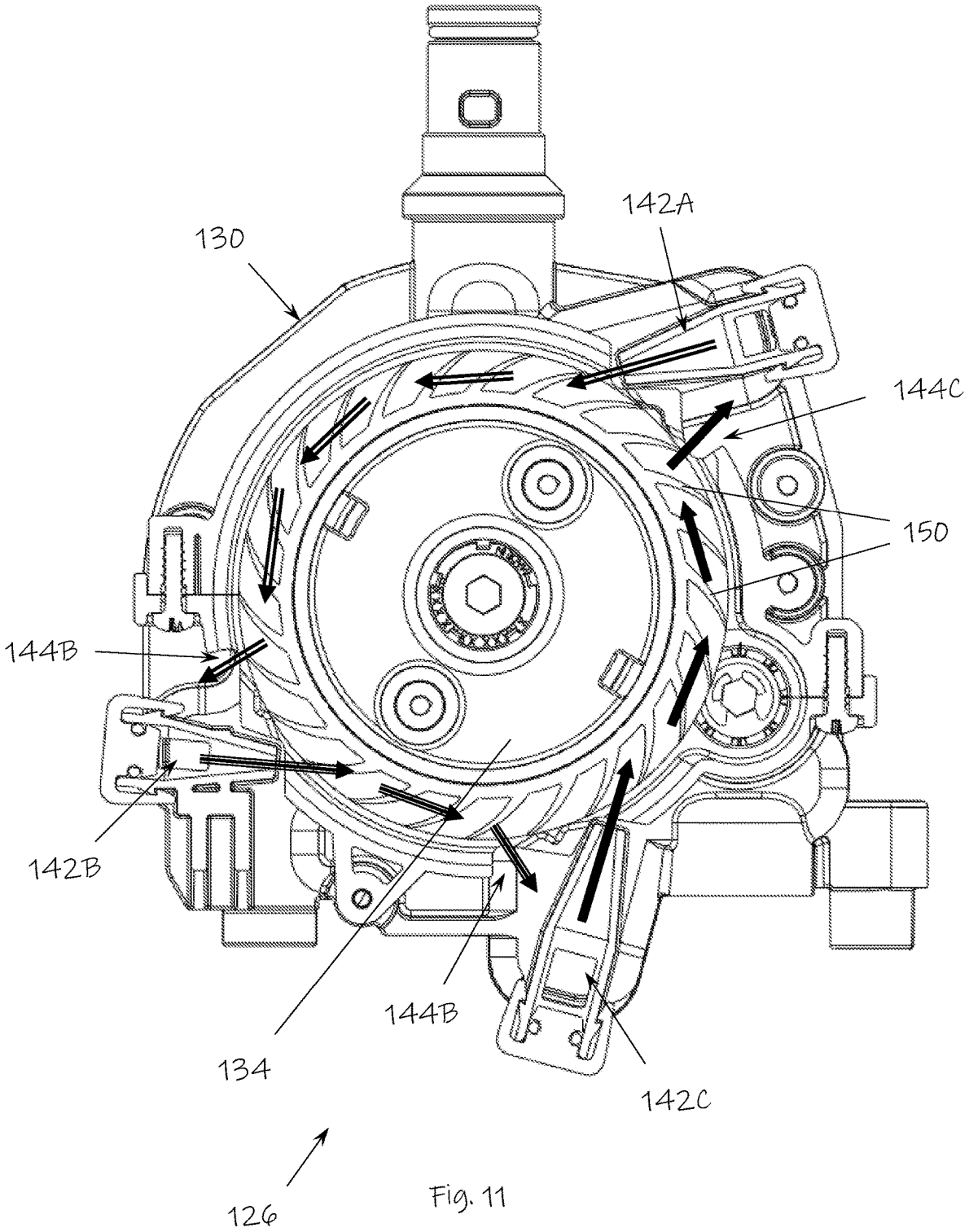
FIG. 11 is sectional view of components of the drive system of FIG. 10 showing principally a series of nozzles, vanes, and water exits.

FIGS. 10, 10A, and 11 illustrate portions of drive system 126 of cleaner 10. Drive system 126 may include hydraulic engine 130 comprising manifold 130A, housing 130B-C, hydraulic turbine 134, and drive shaft 138. Drive system 126 additionally may include components such as nozzles 142A-C (which may be present in manifold 130A), corresponding openings 144A-C in housing 130B-C, and miter gear 146.

As housed in housing 130B-C, turbine 134 may comprise a structure configured to rotate in response to water impinging on its vanes 150. Rotation of turbine 134 in turn produces rotation of drive shaft 138 (which typically is aligned with the axis about which turbine 134 rotates) and of miter gear 146 attached to, or integrally formed with, shaft 138. Directly or indirectly, this rotation is utilized to drive some or all of motive elements 18.

Unlike many hydraulic turbines, in which only a single fluid entrance path exists, turbine 134 of the present invention may include multiple such paths. For example, FIG. 11 illustrates three distinct entrances for water into housing 130B-C, one associated with each of nozzles 142A, 142B, and 142C. Thus, in this example, water jetted from nozzles 142A-C may impinge upon multiple vanes 150 simultaneously. FIG. 11 also illustrates that nozzles 142A-C may be spaced about the circumference of turbine 134, with the spacing being either uniform or non-uniform. Of course, persons skilled in the art will recognize that more or fewer nozzles may be utilized instead of the three depicted in the figure.

Associated with each of nozzles 142A-C is an opening 144A-C. When considering the flow of water within housing 130B-C, the water may encounter each opening 144A-C prior to encountering water entering from the next adjacent nozzle 142A-C. Stated differently, water entering housing 130B-C via nozzle 142A encounters opening 144A prior to encountering nozzle 142B; water entering housing 130B-C via nozzle 142B encounters opening 144B prior to encountering nozzle 142C; and water entering housing 130B-C via nozzle 142C encounters opening 144C prior to encountering nozzle 142A. In this manner, most of the water entering housing 130B-C from a particular nozzle exits the housing 130B-C rather than collide with water entering housing 130B-C from the next circumferentially-adjacent nozzle. The result is an efficient use of the pressurized fluid received from inlet 54 to produce driving force.

Figure 13A:
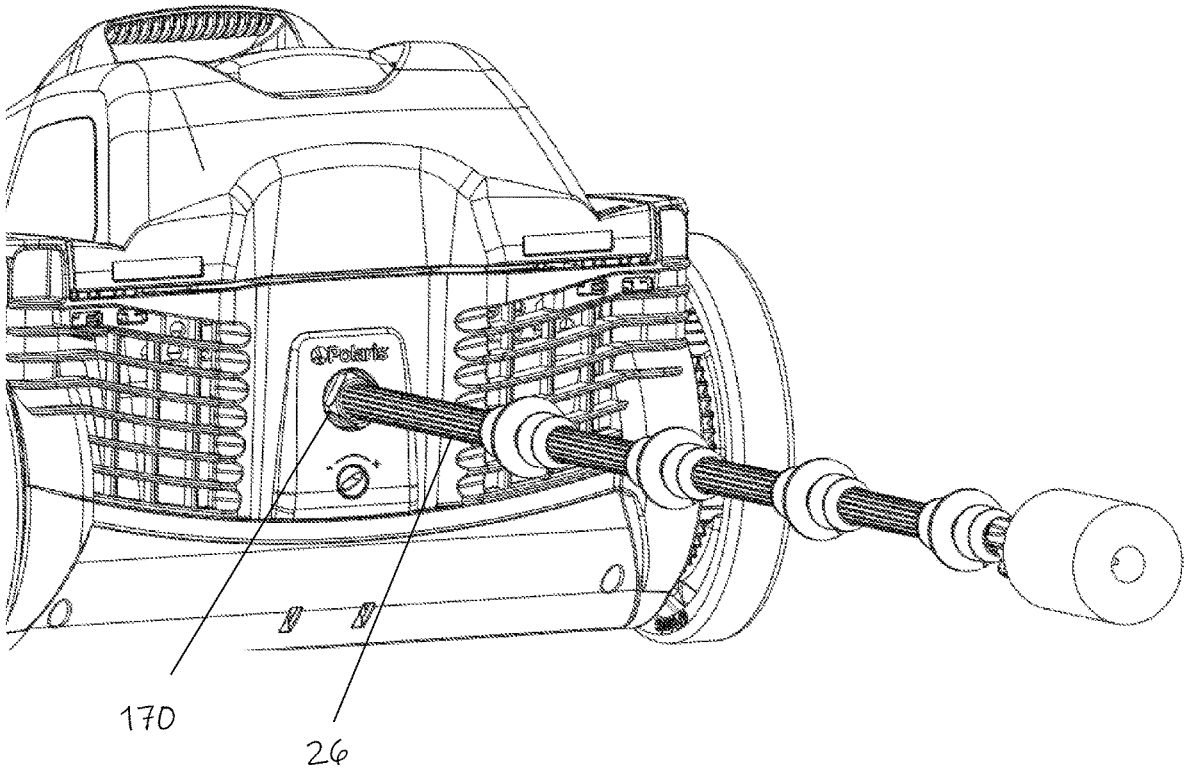
FIG. 13A is a perspective view of a portion of the rear of the cleaner of FIG. 1 showing principally the sweep tail and an adjustment mechanism therefor.
Figure 13B:
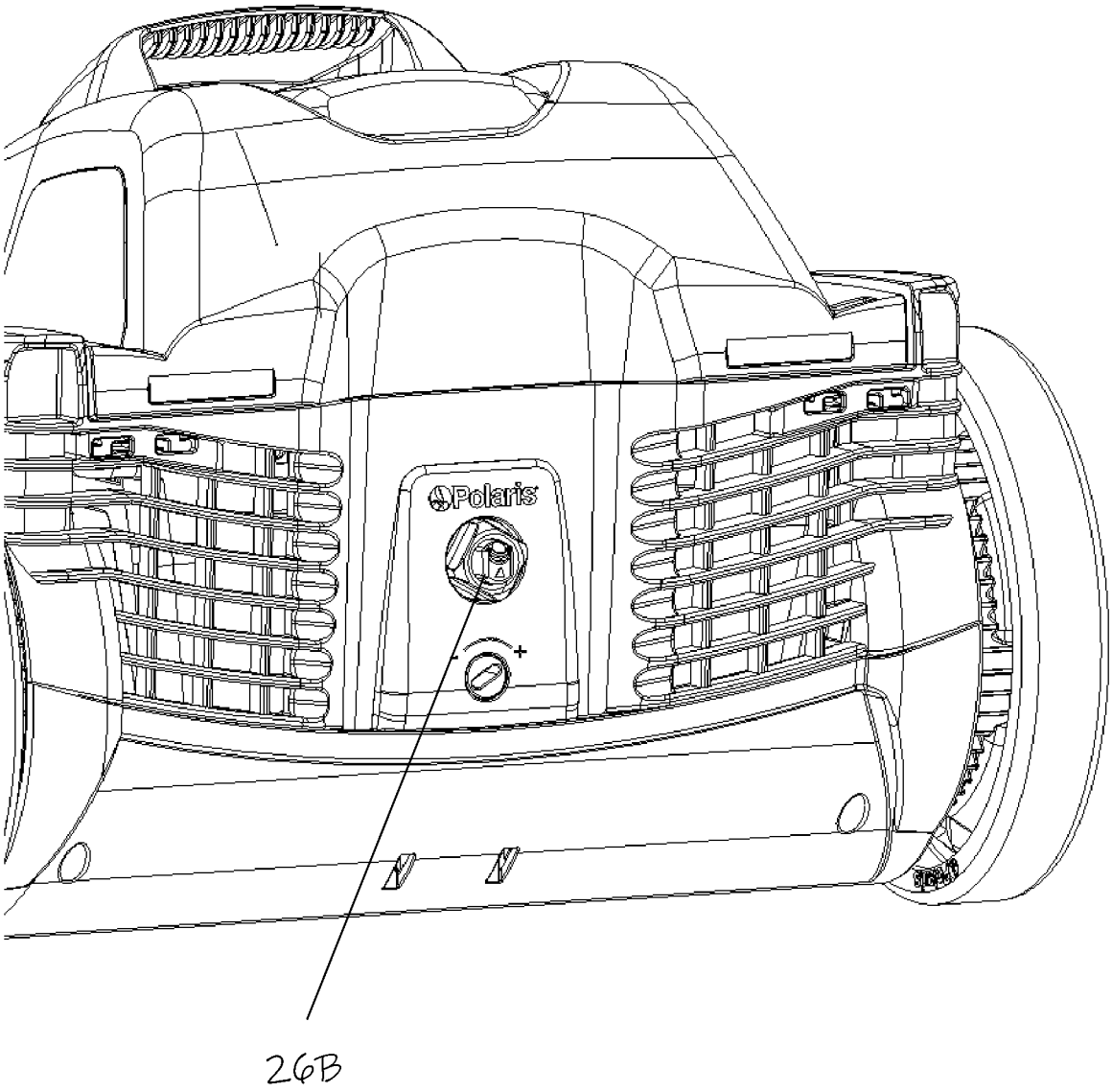
FIG. 13B is a perspective view of a portion of the rear of the cleaner of FIG. 1 showing principally a thrust jet and an adjustment mechanism therefor.
Figure 14:
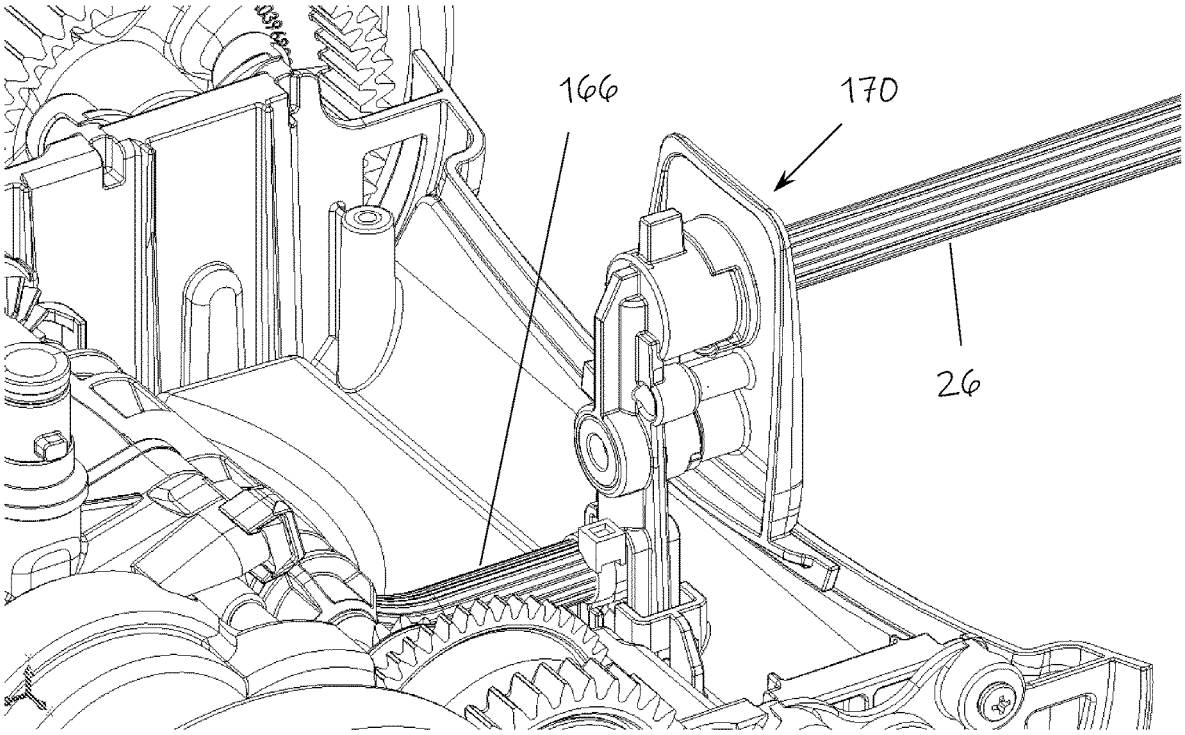
FIG. 14 is a perspective view of the adjustment mechanism of FIG. 13A-B.
Figure 15:
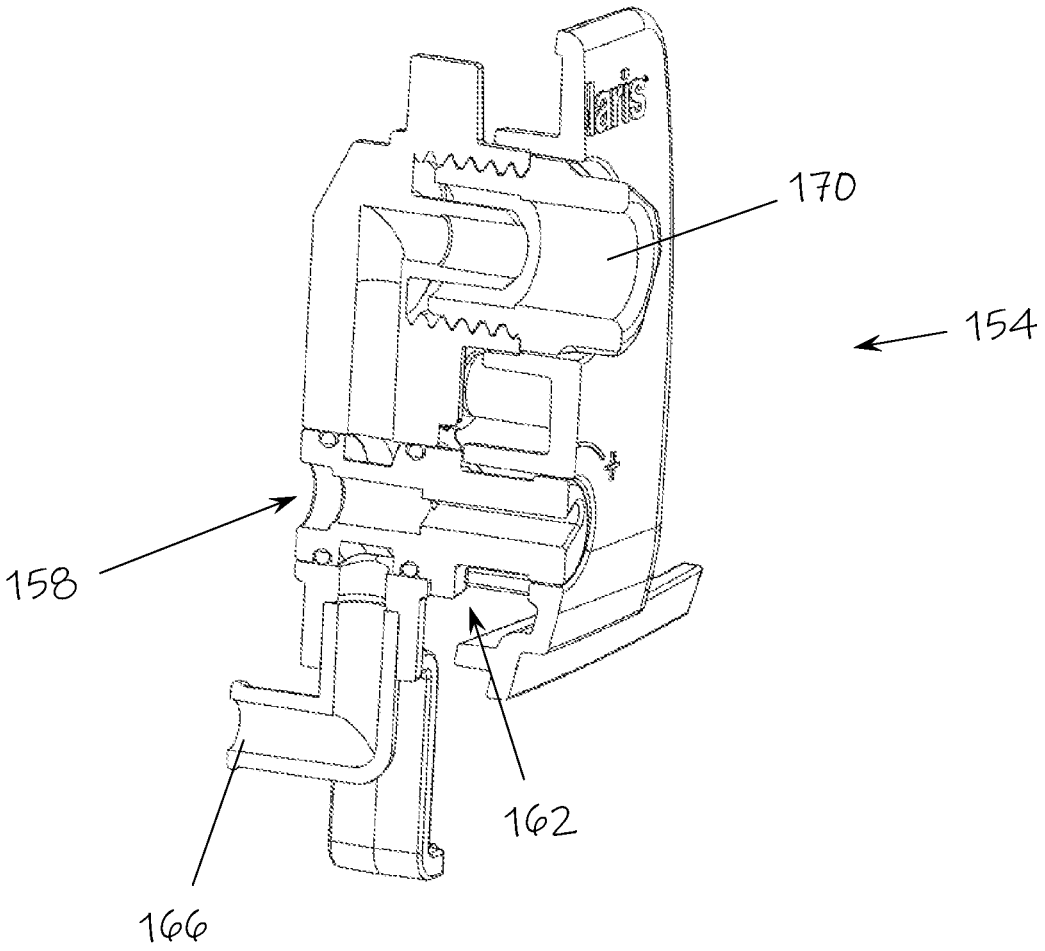
FIG. 15 is a sectional view of the adjustment mechanism of FIG. 13A-B.

FIGS. 13A-15 detail aspects of adjustment mechanism 154 associated with hydraulic accessories such as sweep tail 26 and thrust jet 26B. Mechanism 154 advantageously includes valve 158 having stem 162 positioned at or near rear 34 and capable of being accessed externally of body 14 and rotated as, for example, by a tool such as a screw driver. Rotating stem 162 changes the size of the passage through which pressurized water (from conduit 166) flows to sweep tail 26 or thrust jet 26B, hence changing the flow rate to the tail 26 or jet 26B. FIGS. 13A-B and 14 also illustrate that sweep tail 26 or thrust jet 26B may be attached to body 14 by pushing a proximal end of the accessory over a barb and clamping it to the body 14 using a threaded nut 170. Other attachment means may be employed instead, however.

Yet additionally, cleaner 10 may include features facilitating its assembly (and disassembly). In particular, each of top cover 174, front grille 178, and chassis 182 may comprise, among other things, parts of body 14 of cleaner 10. Consistent with FIG. 16, front grille 178 and adjustment mechanism 154 may be trapped between chassis 182 and top cover 174 for assembly, hence not requiring any fasteners to fix the positions of the grille 178 and mechanism 154. Similarly, no fasteners need be removed from grille 178 and mechanism 154 when front grille 178 is detached from chassis 182.

Illustrated in FIGS. 17A-F are aspects of interface or connector 186 available for use in connection with cleaner 10. Connector 186 is designed as a "quick-connect" device and may connect inlet 54 of body 14 to a water hose without using any tools. As shown especially in FIGS. 17B-C, first end 188 of connector 186 may be frictionally pushed onto inlet 54 so that post 190 of inlet 54 is fitted within track 194 of connector 186. Connector 186 then may be rotated so that post 190 moves within track 194 past detent 198 (FIG. 17D), thus maintaining engagement of the connector 186 and inlet 54 even if pressurized water is not flowing through the hose to the connector 186.

Figure 17A:
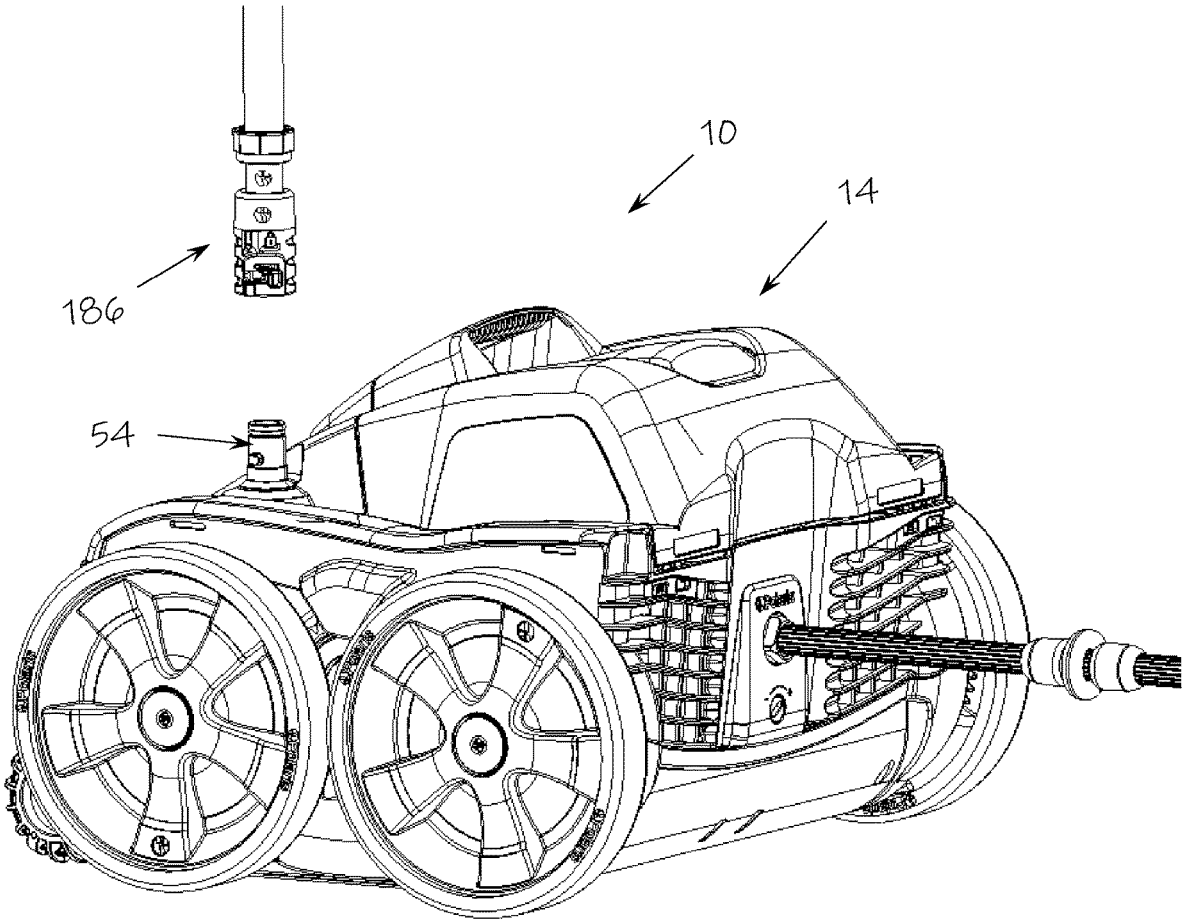
FIGS. 17A-F are views of a connector for use in connection with the cleaner of FIG. 1.
Figure 17B:
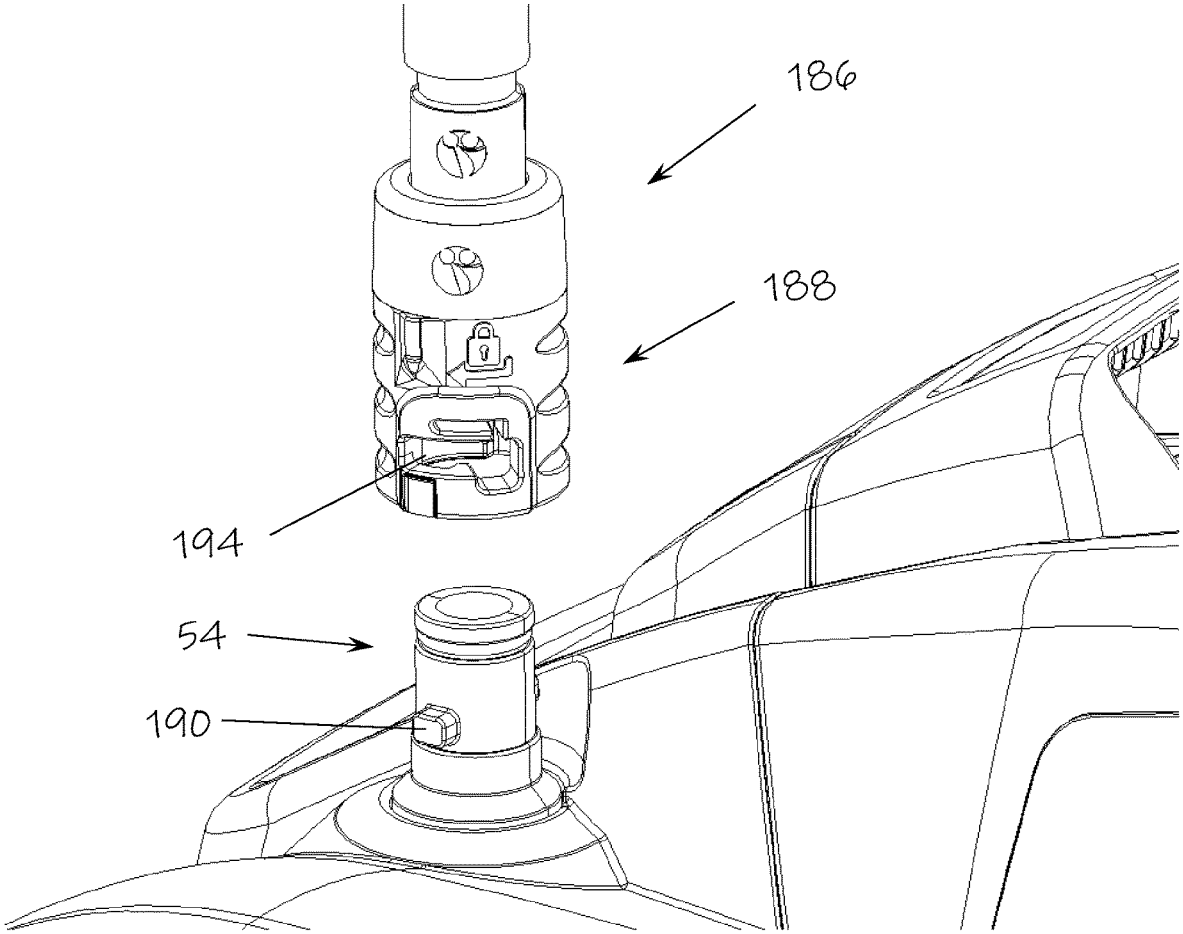
Figure 17C:
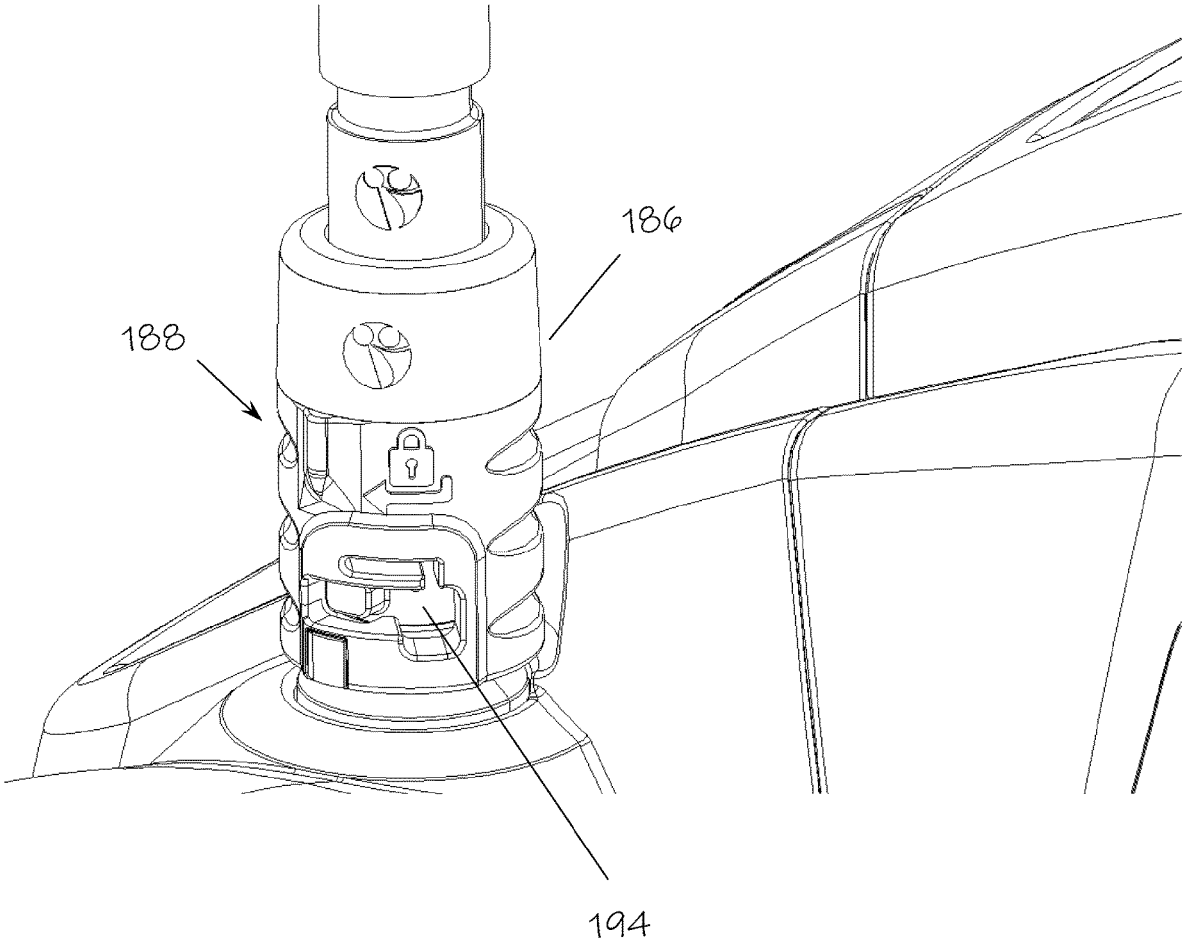
Figure 17D:
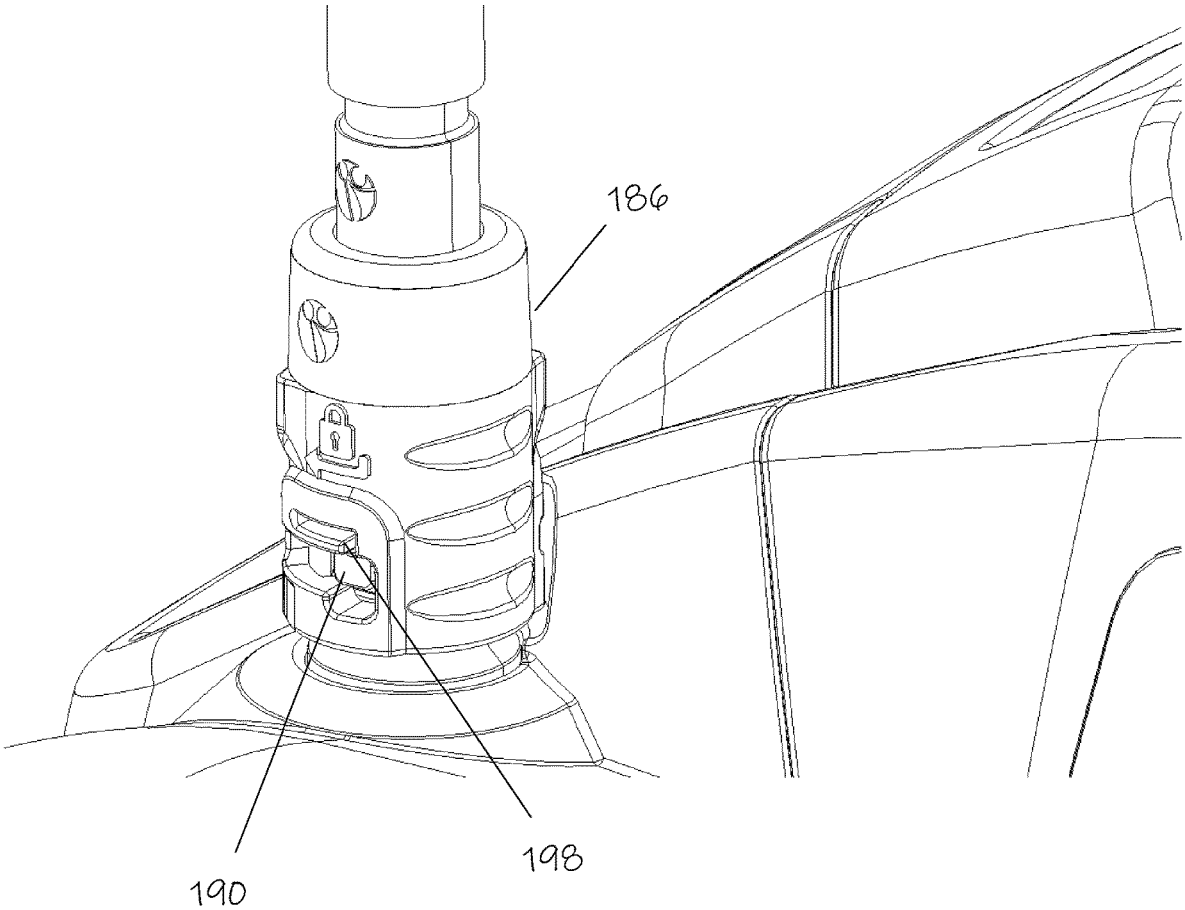
Figure 17E:
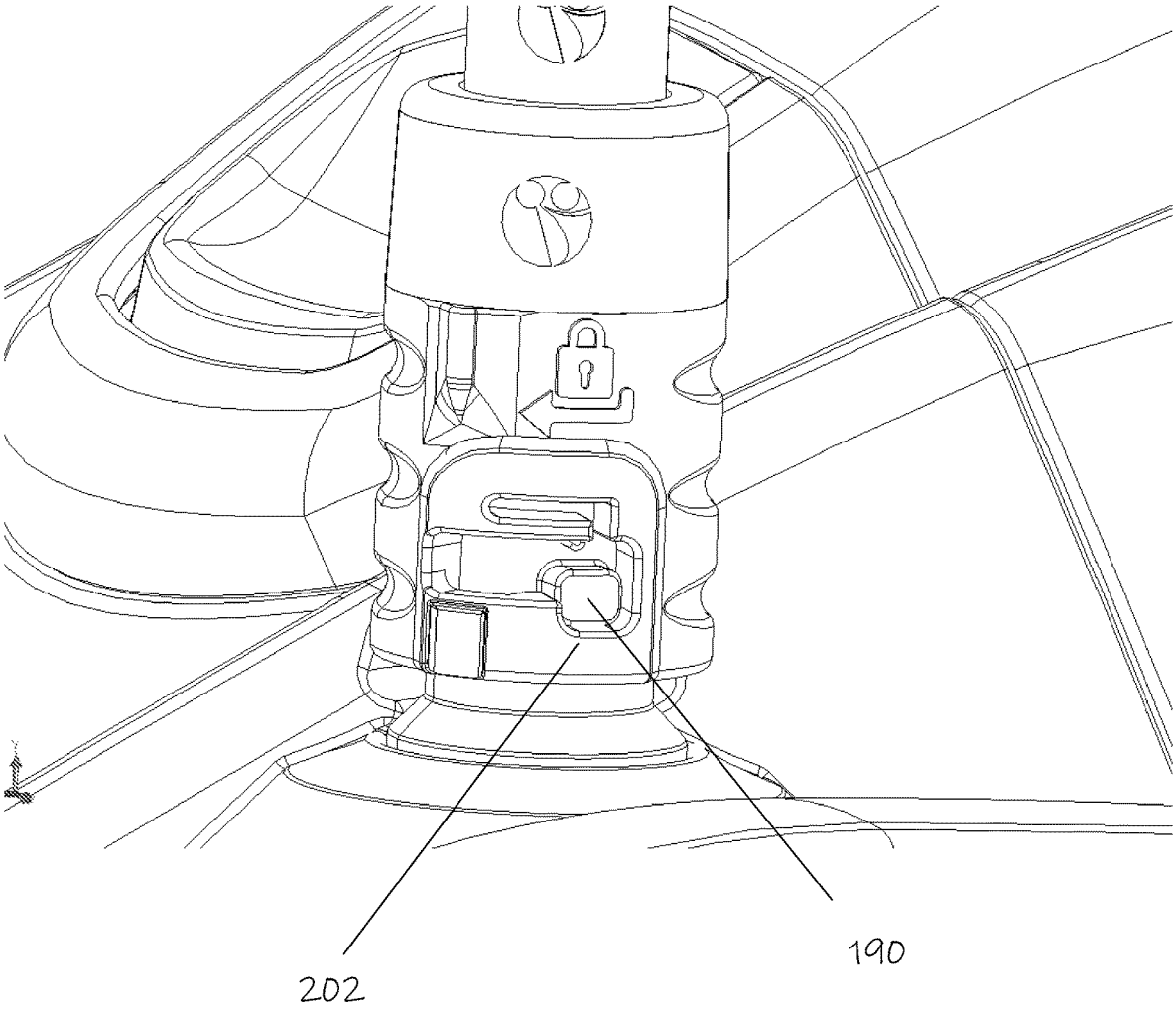
Figure 17F:
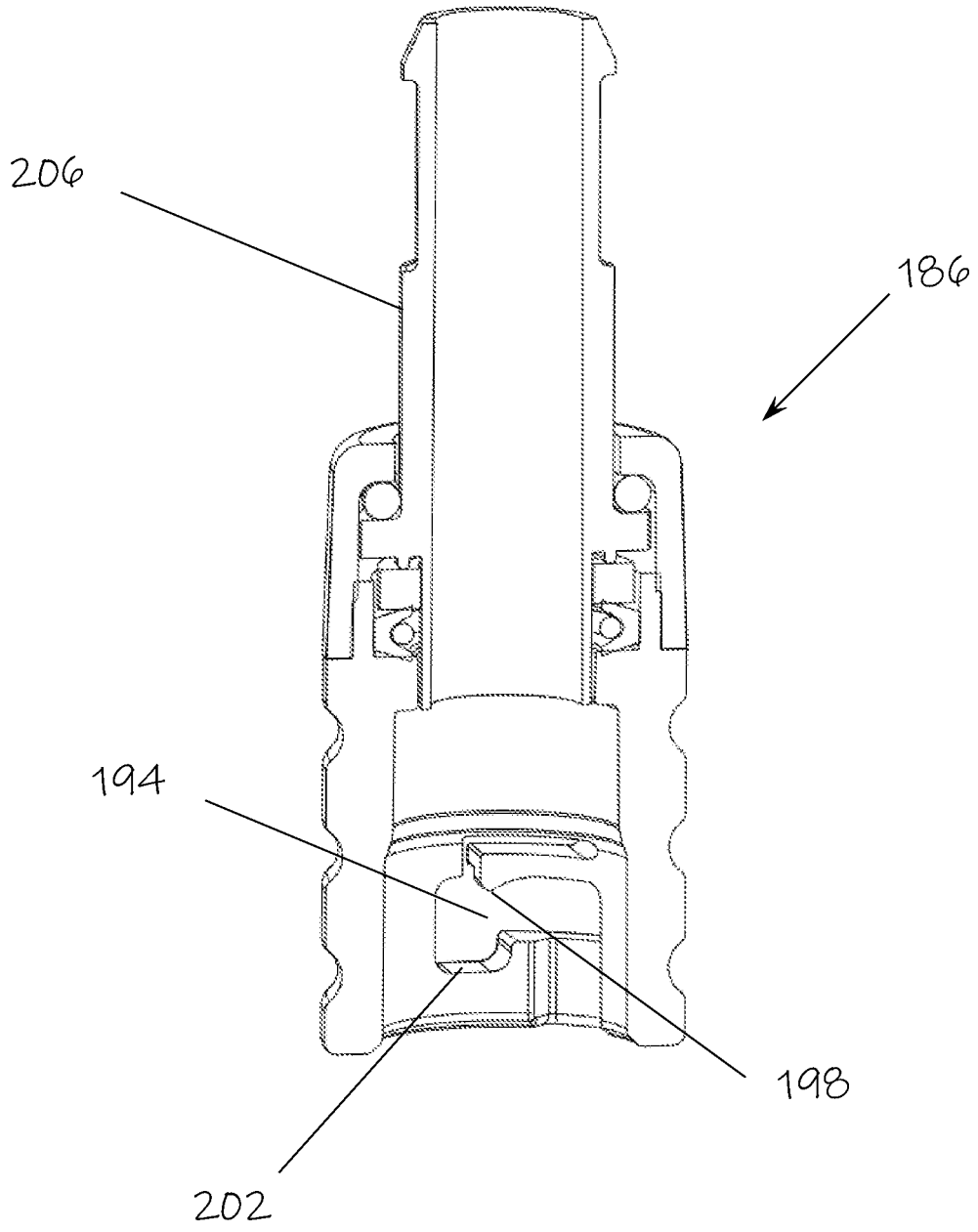

During operation of cleaner 10, internal pressurization of connector 186 and inlet 54 move the connector 186 so that post 190 nestles into pocket 202 of track 194, as depicted in FIG. 17E. Additionally shown in the cross-sectional view of FIG. 17F is that connector 186 may include second end 206 configured to swivel (and to do so independent of rotation or other movement of first end 188). Allowing end 206 to swivel reduces the likelihood that the hose to which it connects will entangle as cleaner 10 moves within a swimming pool.

Figure 18A:
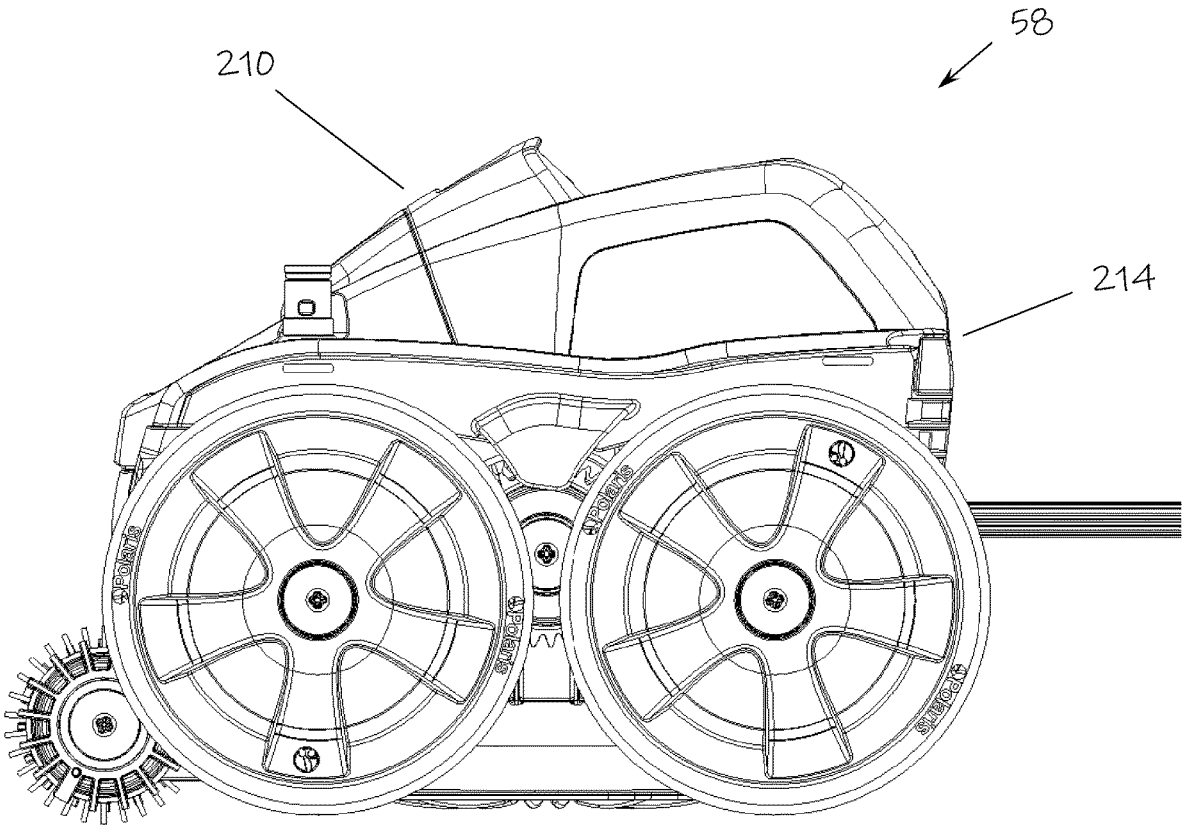
FIGS. 18A-Q illustrate actions in removing the canister of FIG. 5 from the cavity of FIG. 7 and returning it thereto.
Figure 18B:
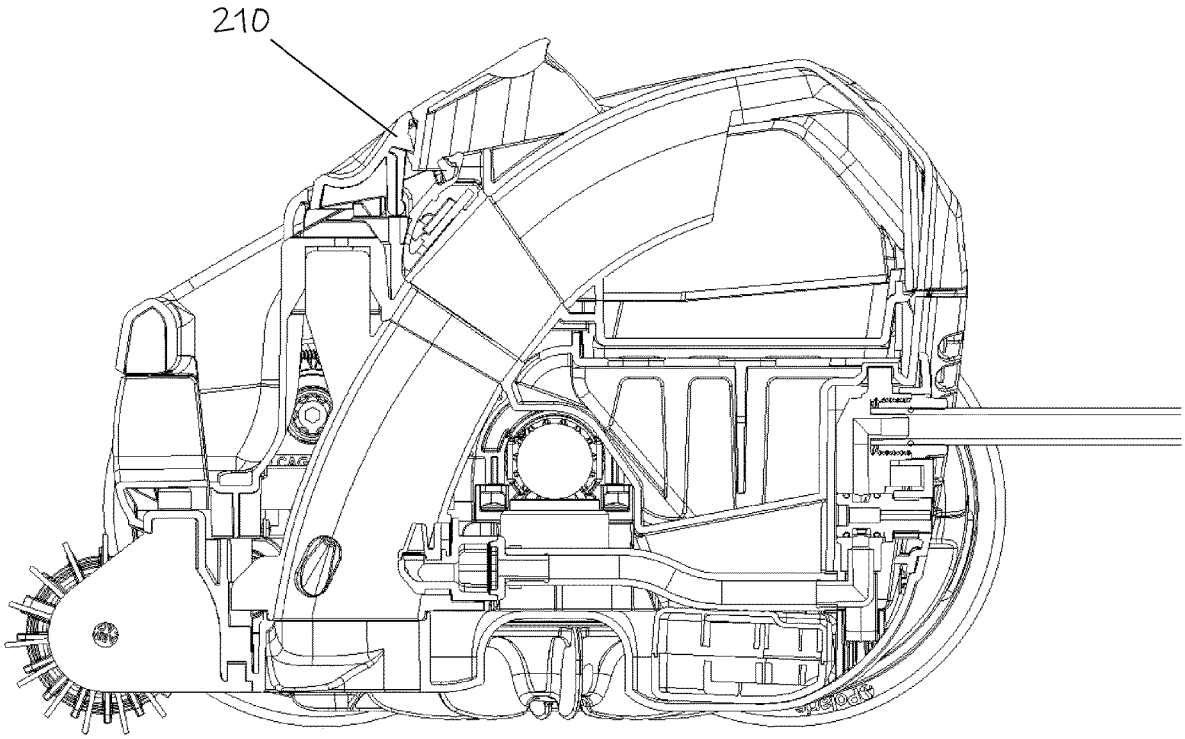
Figure 18C:
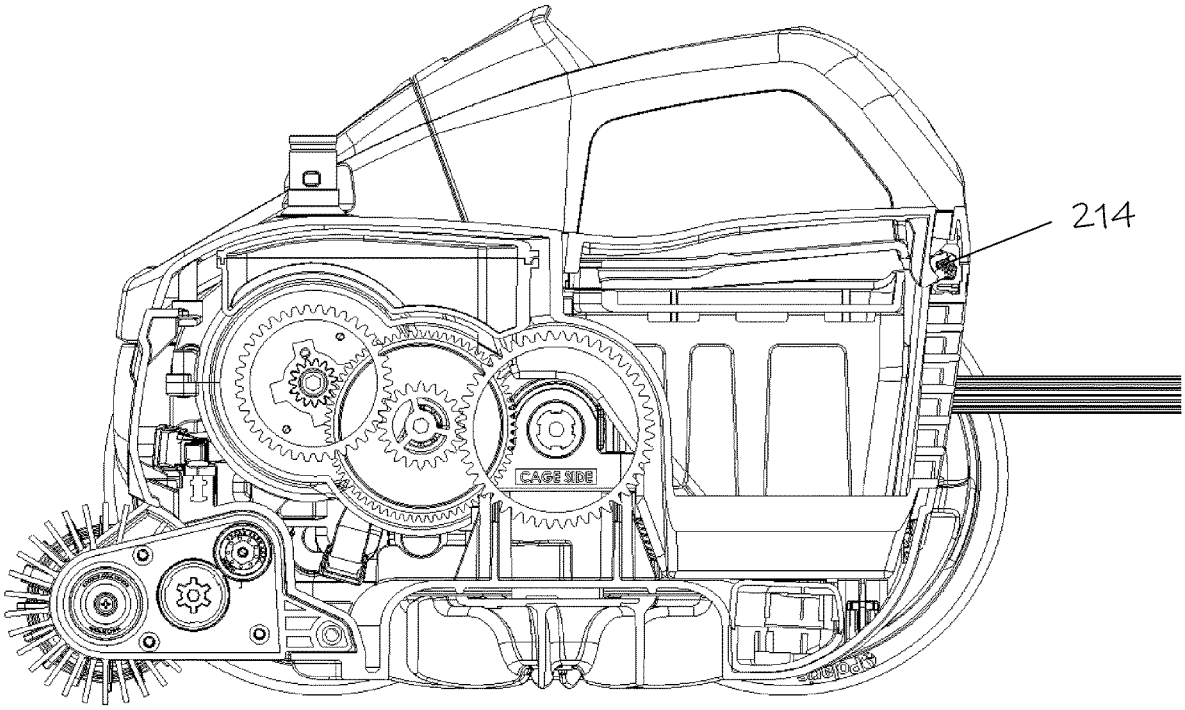

As noted earlier, canister 58 may be lowered linearly into cavity 94 for latching but, after unlatching, may be rotated out of the cavity 94. FIGS. 18A-Q illustrate such linear and rotational motions. Shown in FIGS. 18A-E is that canister 58 may contain portions of both (nominally) forward latch 210 and (nominally) rear latch 214 as well as release button 218. To remove canister 58 from cavity 94, one may depress button 218 so as to unlatch forward latch 210. Thereafter, canister 58 may be rotated, as depicted by arrow C of FIG. 18F, until neither forward latch 210 nor rear latch 214 remains engaged (see also FIGS. 18P-Q). Canister 58 then may be withdrawn from cavity 94 as shown in FIG. 18G. Canister 58 may be returned to body 14 by lowering the canister 58 linearly into the cavity 94 (see FIGS. 18H-I). Doing so causes latches 210 and 214 to spring out of the way and then return to their locking positions (see FIGS. 18J-O).

Figure 19A:
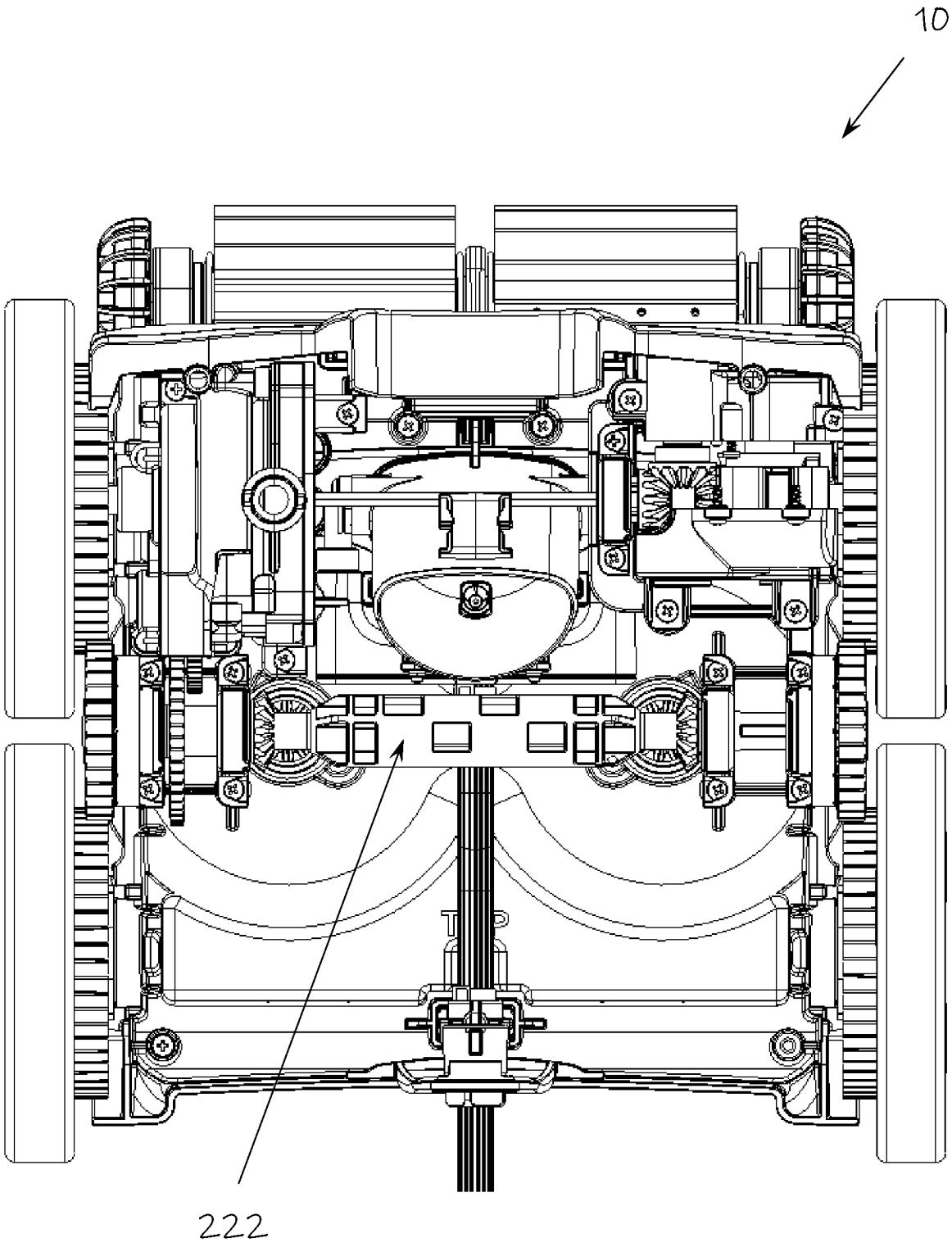
FIGS. 19A-C are views of an idler assembly for use in connection with the cleaner of FIG. 1.
Figure 19B:
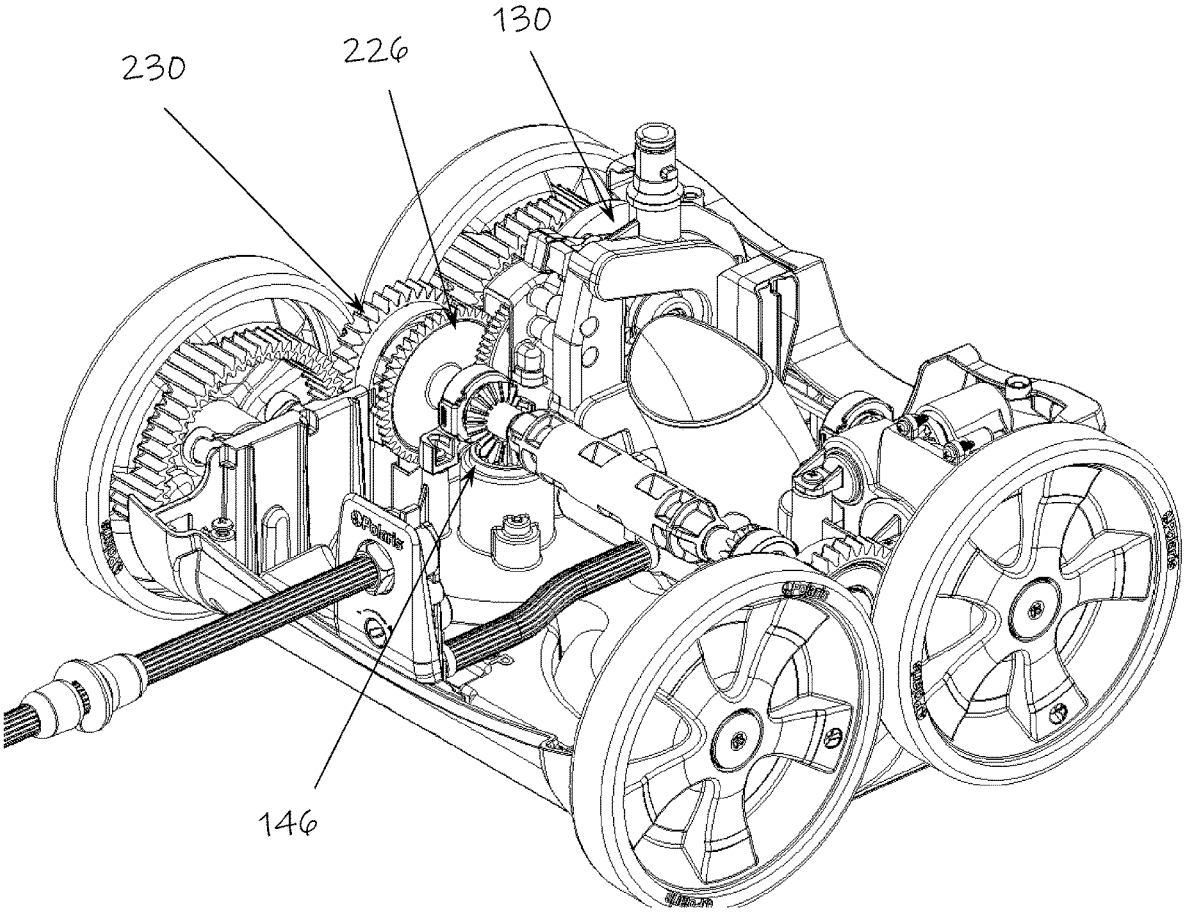
Figure 19C:
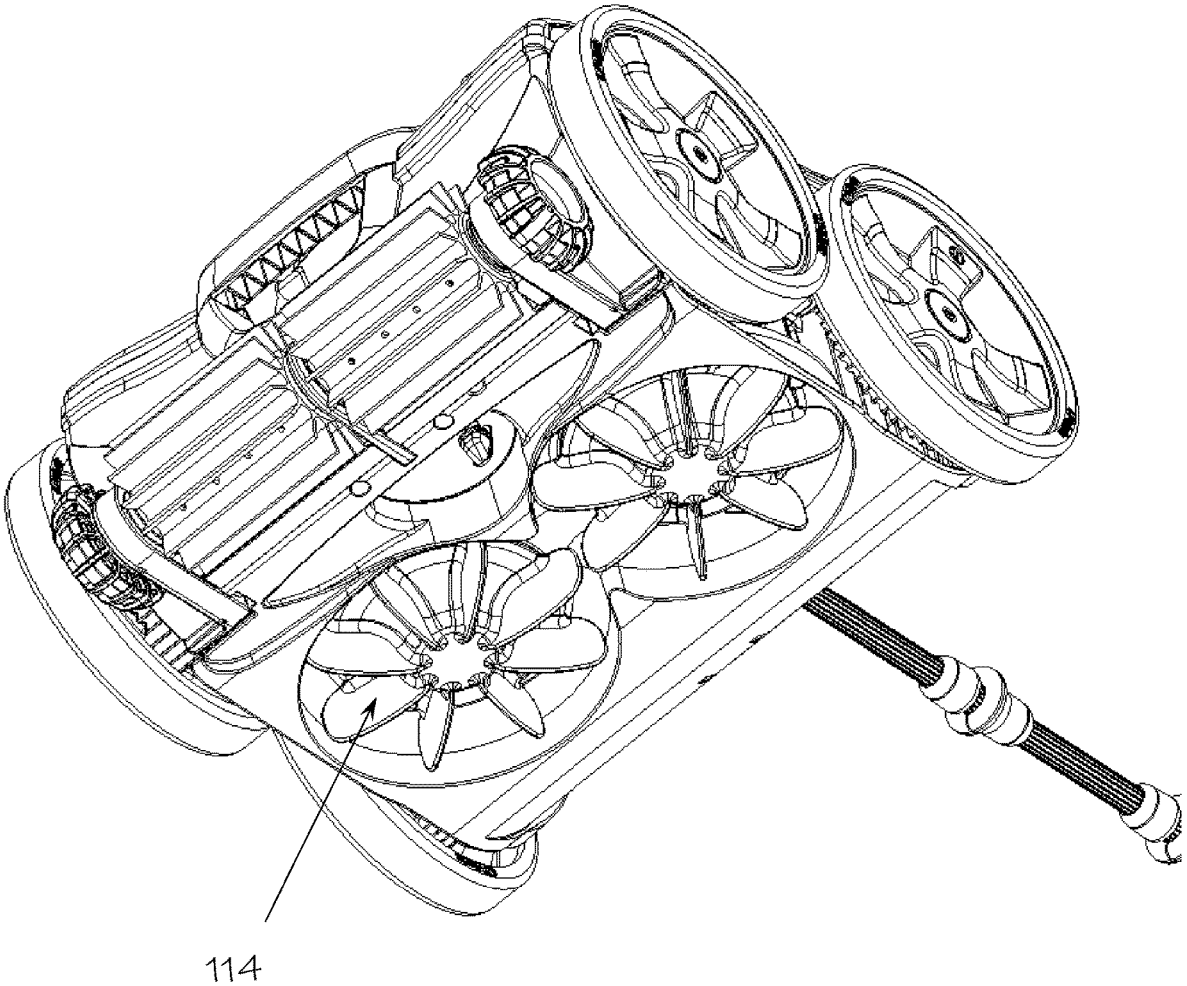

FIGS. 19A-C illustrate aspects of idler assembly 222 which may be included as another part of drive system 126 of cleaner 10. As shown in FIG. 19B, assembly 222 may include a first gear 226 driven by a gear of hydraulic engine 130. Assembly 222 also may include at least one idler gear 230 configured to transfer torque from, e.g., wheel 18A to wheel 18C or from wheel 18B to wheel 18D. Idler gear 230 may be mounted on a free-spinning bearing and rotate independently of the remainder of assembly 222. Also depicted in FIG. 19B is a miter gear 146 which may be used to drive at least one downforce turbine 114.

Text appearing in drawings of the Provisional Application includes:

FIG. 6: Canister 2 stage filter with bypass

Keep a pressure differential across the fine mesh filter to bias debris against the screen (don't design the bypass too large)

Snap on fine filter

Leave in or take the fine filter

Push canister straight in, unlatch and pivot the canister out

Exhaust canister into internal cavity of cleaner, allows upper window with a large amount of screen area Clear top with clear vac tube Vac tube on lower canister becomes handle 2 pocket canister Increases mesh area FIG. 7: Image shows that the canister cavity helps isolate the debris laden water zone (water exiting the canister) from the drive system FIG. 8: Multi section vac tube Keeps debris out of engine area because the canister exhausts inside the cleaner Canister cavity needs to isolate the canister from the drive system 5 Section vac tube 1) Chassis vac tube communicates the vacuum to the pool surface and connects with the inlet geometry that helps encourage a very wide cleaning path.

2) Main vac tube houses the venture jets and diverts the water back toward the canister 3) Vac tube in Top Cover helps isolate the fine debris laden water exiting the canister from the drive system of Magnus 4) Lower canister vac tube doubles as a lower canister handle 5) Clear vac tube help show debris in canister

FIG. 9:

Debris laden water travels up 5-section vac tube and enters the canister

The water and fine debris is forced through the 1st stage filter of coarse mesh (~600 micron). The larger debris is captured in the first stage of the filter The water and fine debris continues to be forced out of the second stage fine filter (~200 micron). The water and debris can exit the second stage through the fine filter mesh or through unobstructed bypass openings.

The bypass openings are sized optimally

1) Large enough to continue to allow a high flow of water through the cleaner from the venturi vacuum system 2) Small enough to keep a pressure differential across the fine mesh screen to force the water through the mesh even though a bypass is available and to keep fine debris stuck to the fine mesh though water may be flowing past it to the bypass.

Clean water is exhausted from the canister into a chamber in the cleaner. The clean water exits the cleaner into the pool through a low restriction opening in the canister chamber.

FIG. 10: 3 engine jets with inline exhaust before next jet

FIG. 10A:

Manifold with engine nozzles

Engine Housing with hydraulic turbine

FIG. 12: Idler Assembly

Threaded together drive shaft, left hand threads

Idler gears share the same mounting shaft and axis as the drive gear and miter gears that run the down force turbines.

FIG. 13: Tail Valve

Slot allows screw driver, key, etc. to be inserted to turn and adjust the tail water flow

FIG. 15:

Tail sweep is pushed over the barb and clamped on with the threaded nut

Valve stem is trapped between the valve body and external housing

Figure 16:
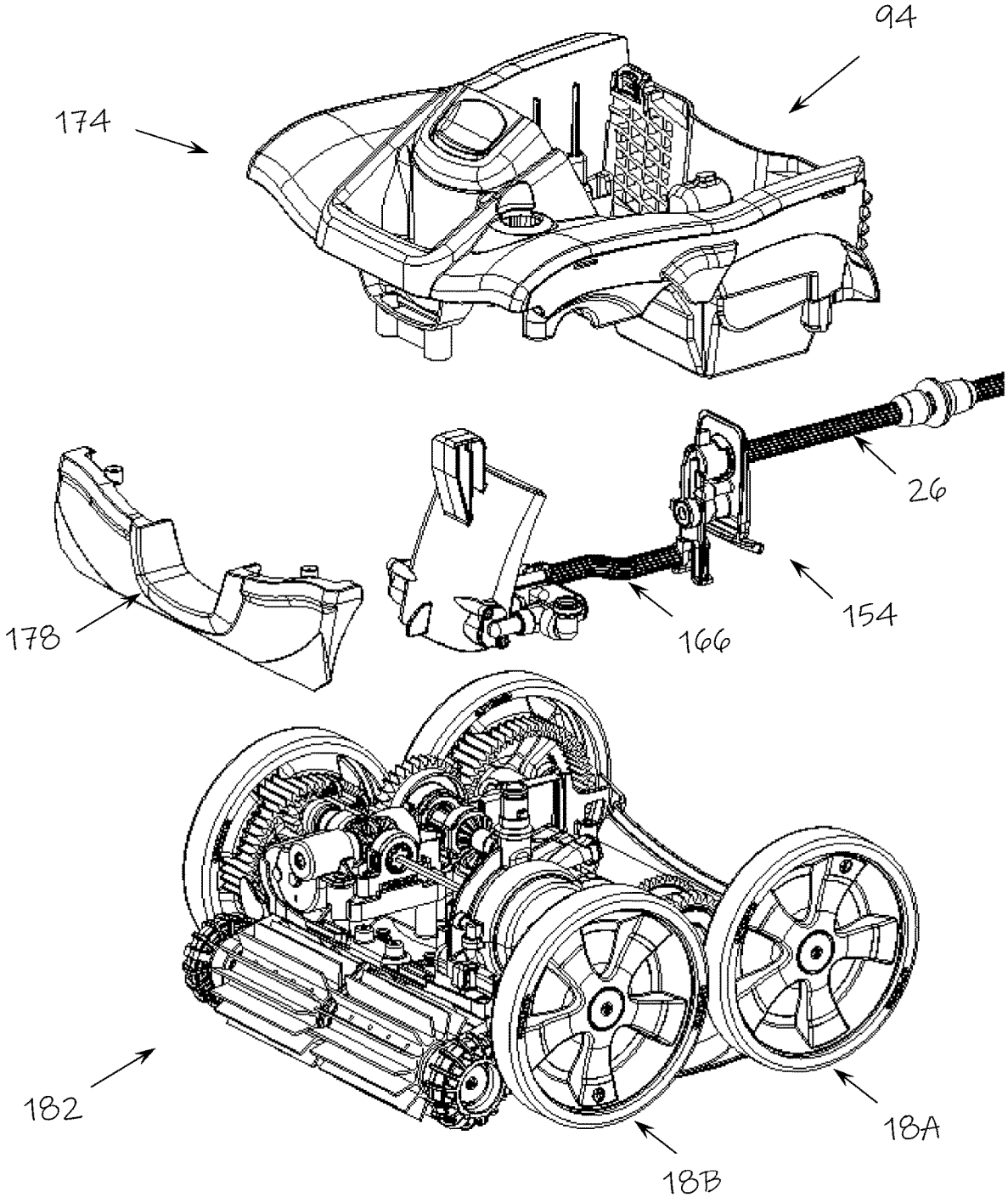
FIG. 16 is an exploded view of portions of the cleaner of FIG. 1.

FIG. 16: Assembly Method

Ease of service, low cost

Front Grille, Vac Tube, Tail Valve are trapped between the Chassis and Top Cover without any screws Chassis makes up the lower portion of vac tube, top cover makes up the upper portion of the vac tube FIG. 17A: Hose quick connect and ball bearing swivel FIG. 17B: Hose quick connect is pushed over the pipe connection FIG. 17C: Hose quick connect is pushed over the pipe connection. A post on the pipe engages the quick connect locking track FIG. 17D: The hose quick connect is rotated so the pipe's post is forced past a detent feature, keeping the quick connect engaged when the system does not have internal pressure.

FIG. 17E: During the cleaner's operation, the quick connect and pipe are internally pressurized which forces the quick connect up and further locking the post into a lower track pocket

FIG. 17F:

Ball bearing swivel, similar in construction to pressure cleaner hose swivels

Section view look at the quick connects locking track and detent feature

Figure 18D:
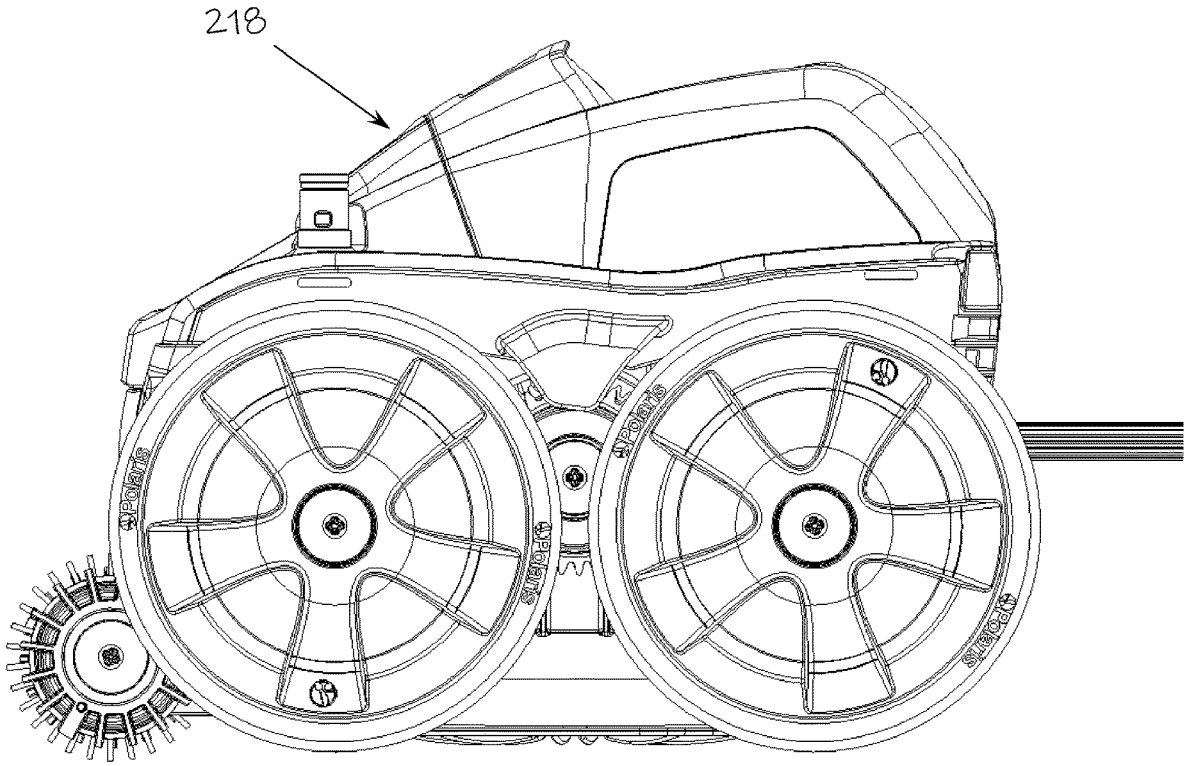
Figure 18E:
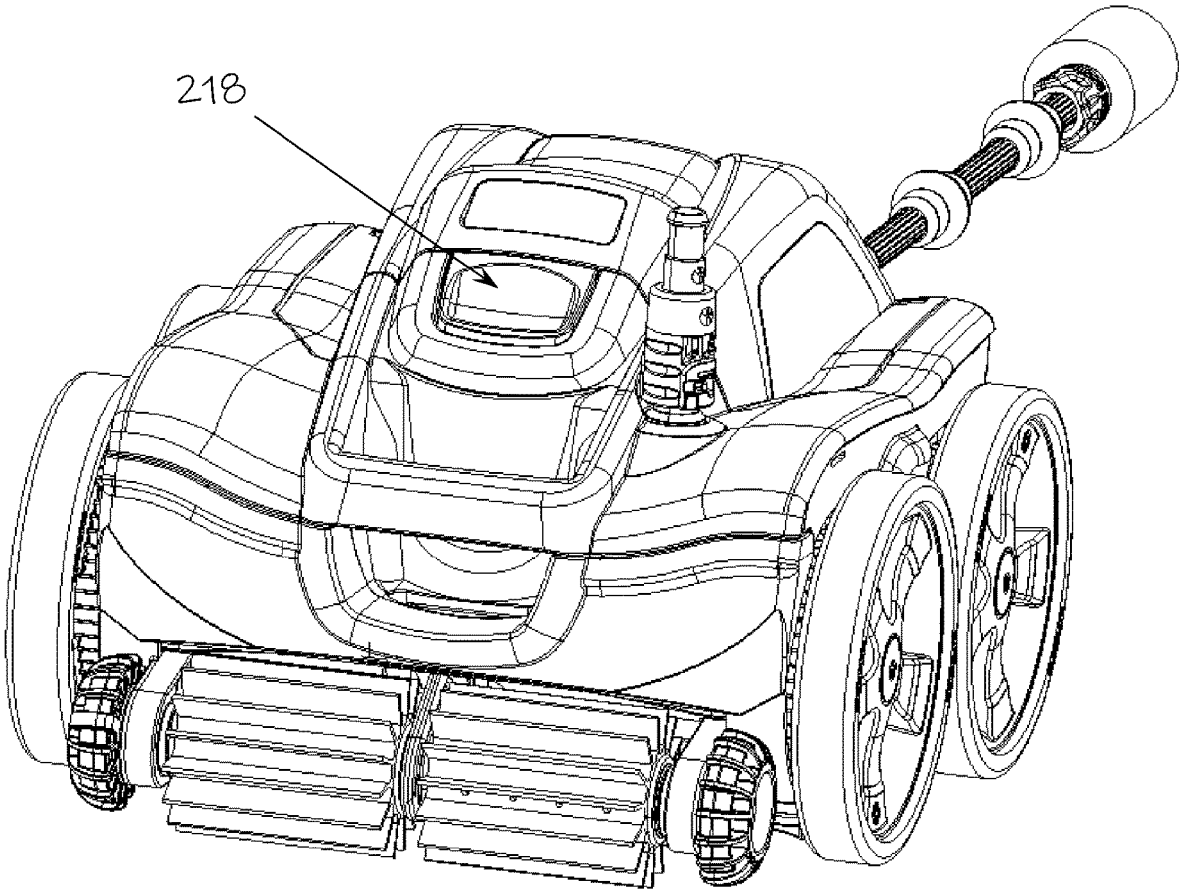

FIG. 18D: Canister Removal—01

Press on canister release button to unlatch the forward canister latch

Figure 18F:
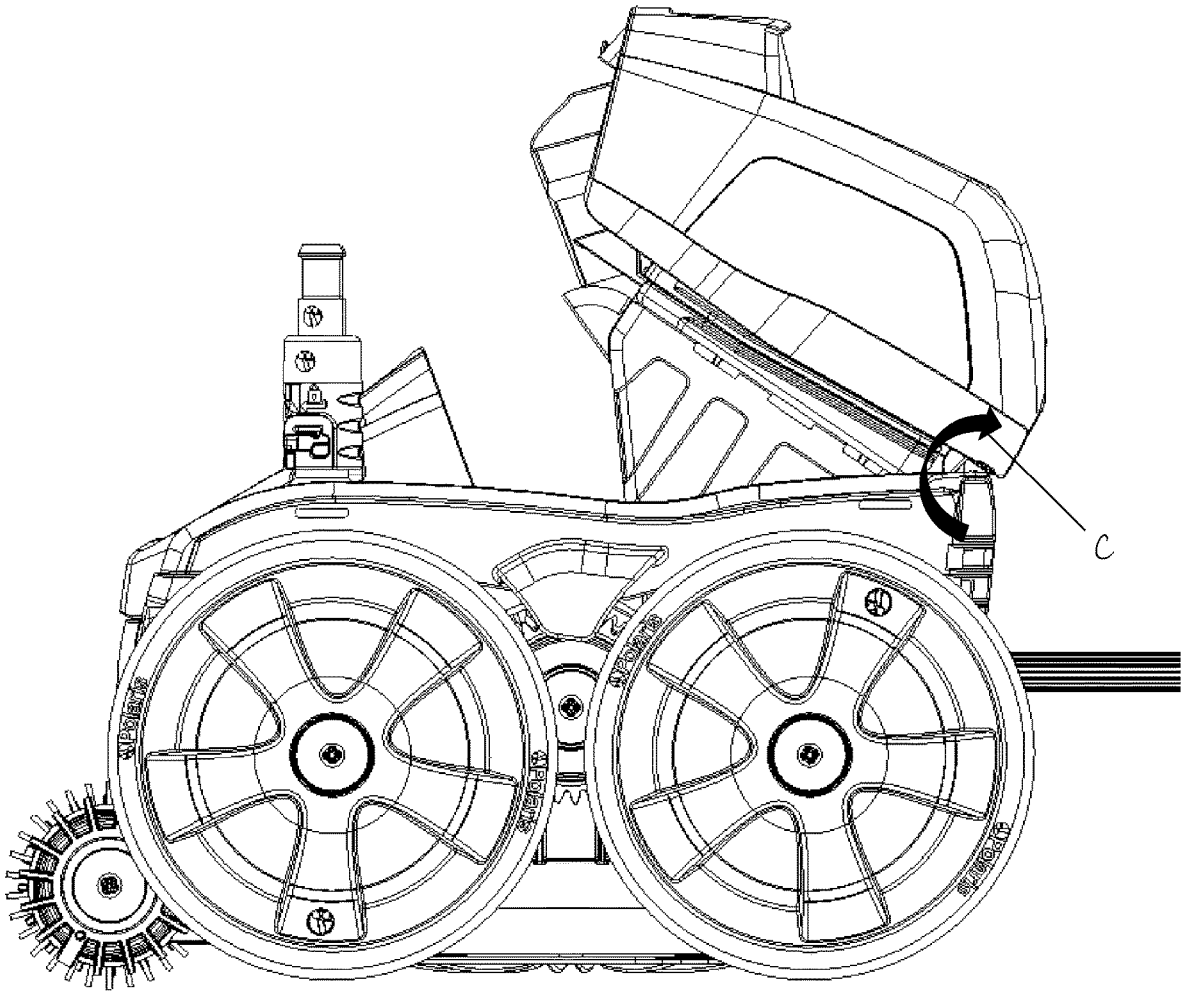
Figure 18G:
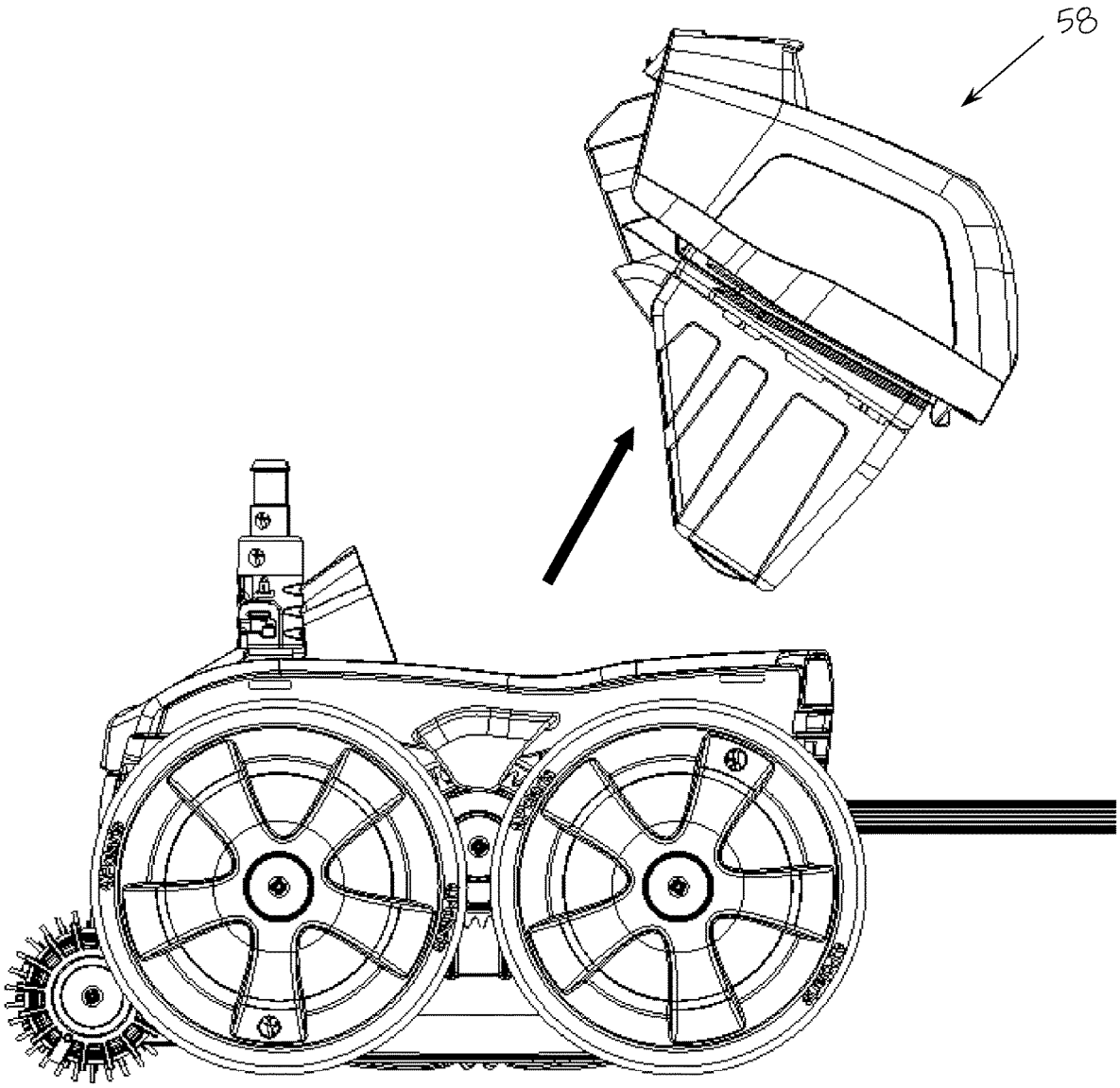

FIG. 18F: Canister Removal—02

Rotate canister about the rear latch and pivot point until the forward canister latch is free and the rear latch is free FIG. 18G: Canister Removal—03

Continue to pull canister out of the pool cleaner's canister pocket

Figure 18H:
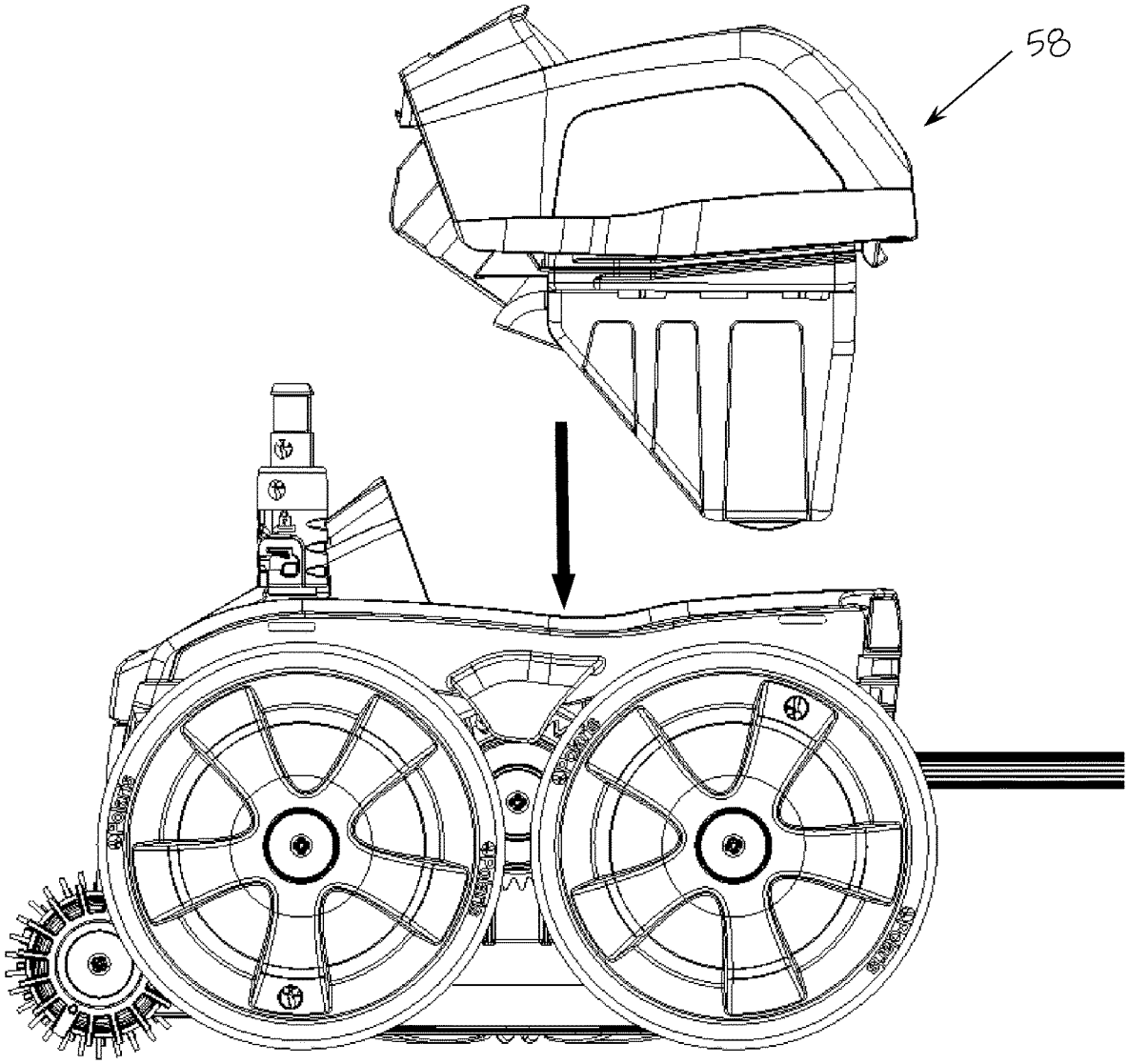
Figure 18I:
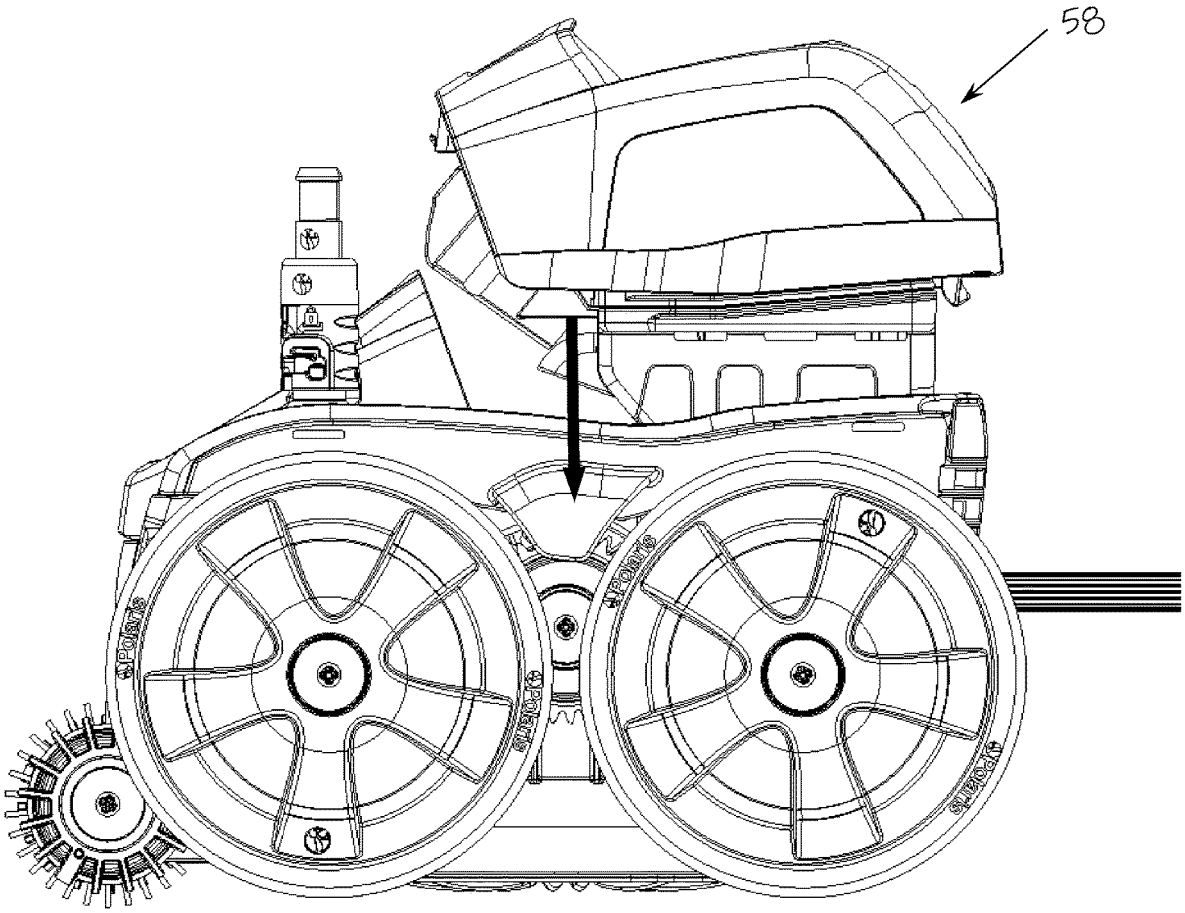

FIG. 18H: Canister Return—01

Guide the canister into the pool cleaner's canister pocket in a vertically down direction.

FIG. 181: Canister Return—02

Guide the canister into the pool cleaner's canister pocket in a vertically down direction.

Figure 18J:
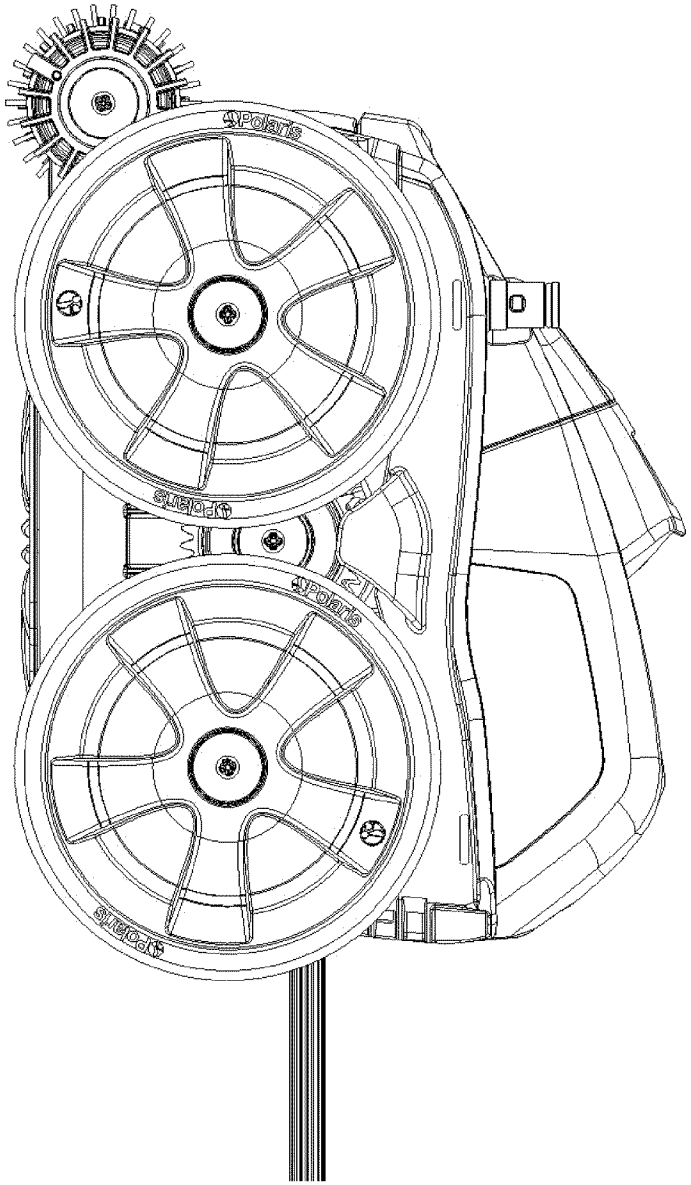

FIG. 18J: Canister Return—03

As the canister pushes past the forward and rear canister latches in a vertically downward direction, the latches will spring out of the way.

Once the canister passes the forward and rear latches, the latches will spring into a locking position.

Figure 18K:
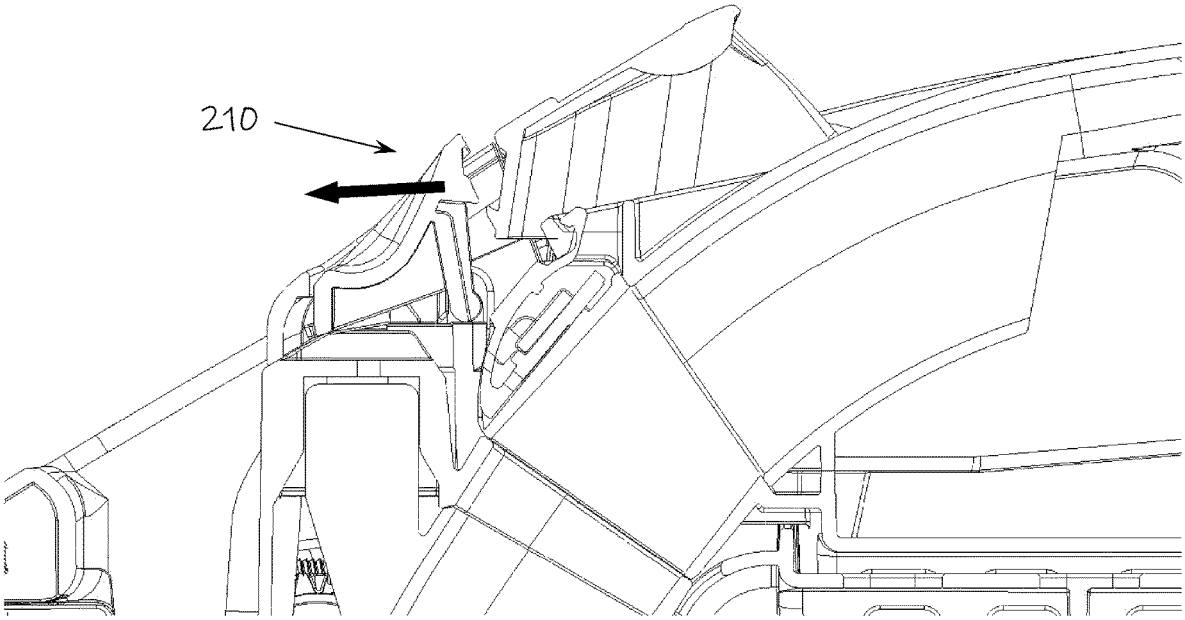

FIG. 18K: Forward Canister Latch—01

Figure 18L:
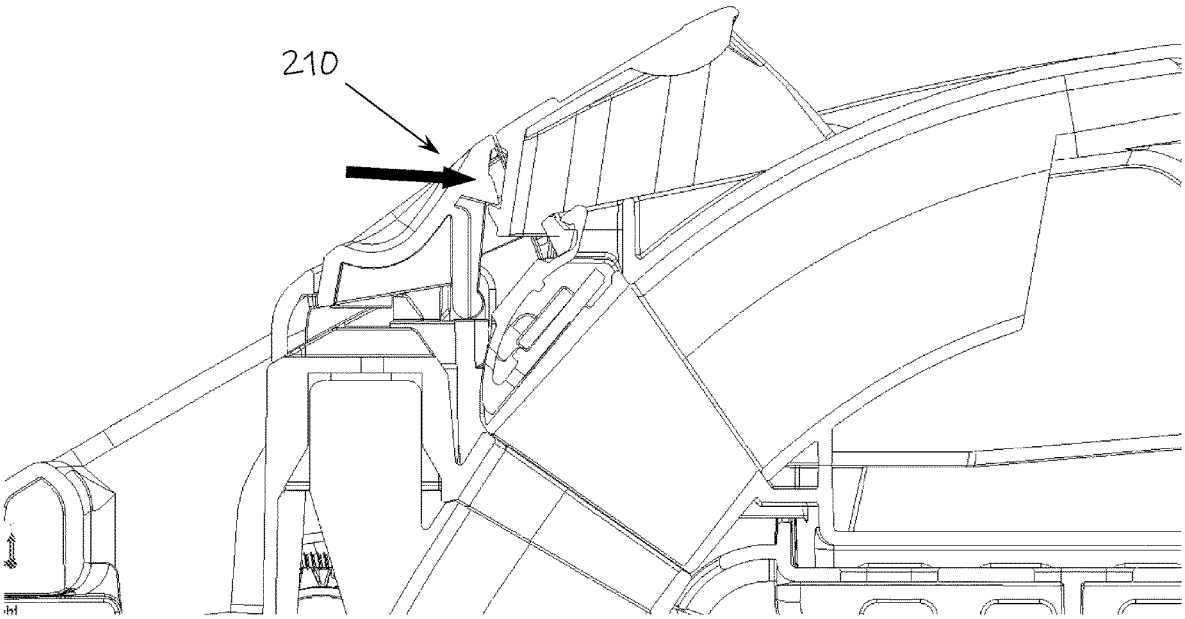

Forward canister latch being pushed out of the way while the canister is returned into the pool cleaner FIG. 18L: Forward Canister Latch—02

Forward canister latch spring loaded into its locked position

Figure 18M:
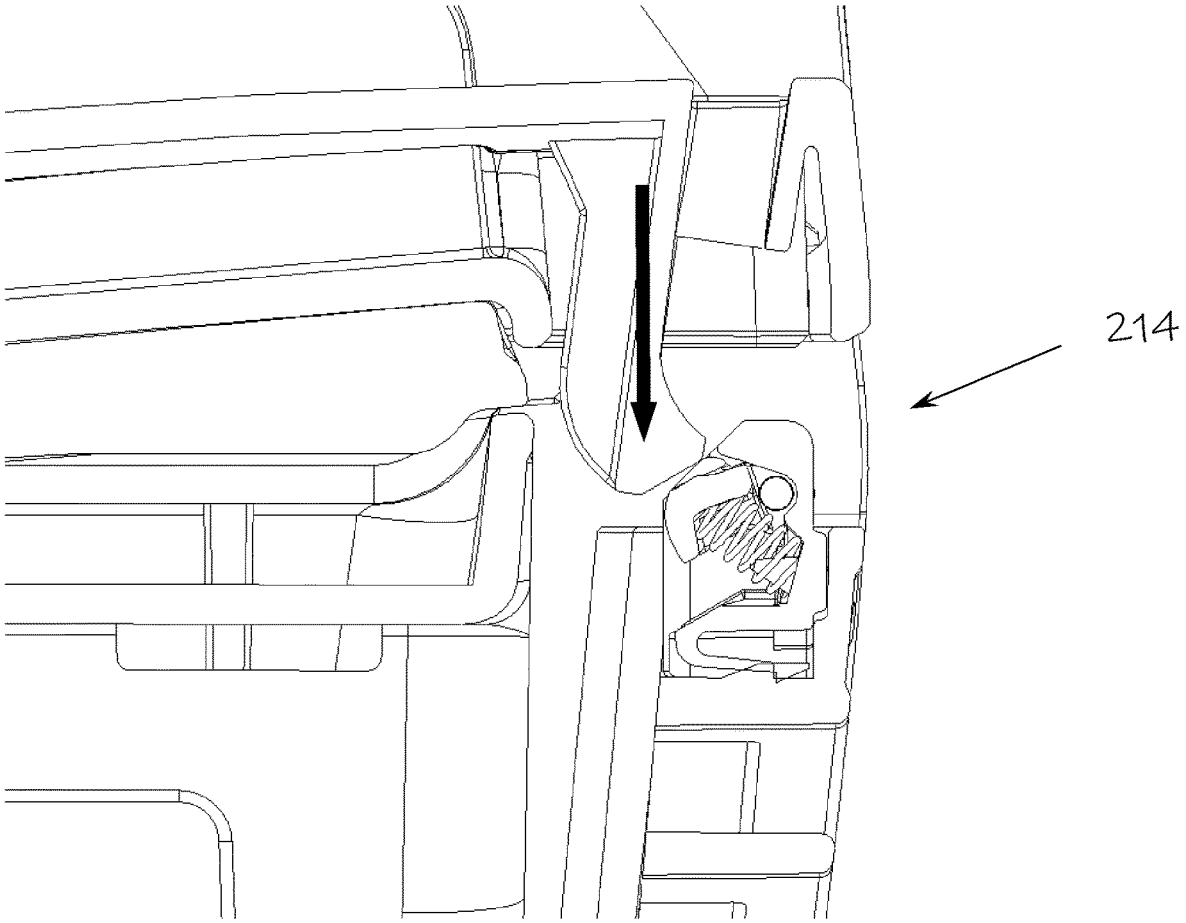

FIG. 18M: Rear Canister Latch and Pivot—01

Figure 18N:
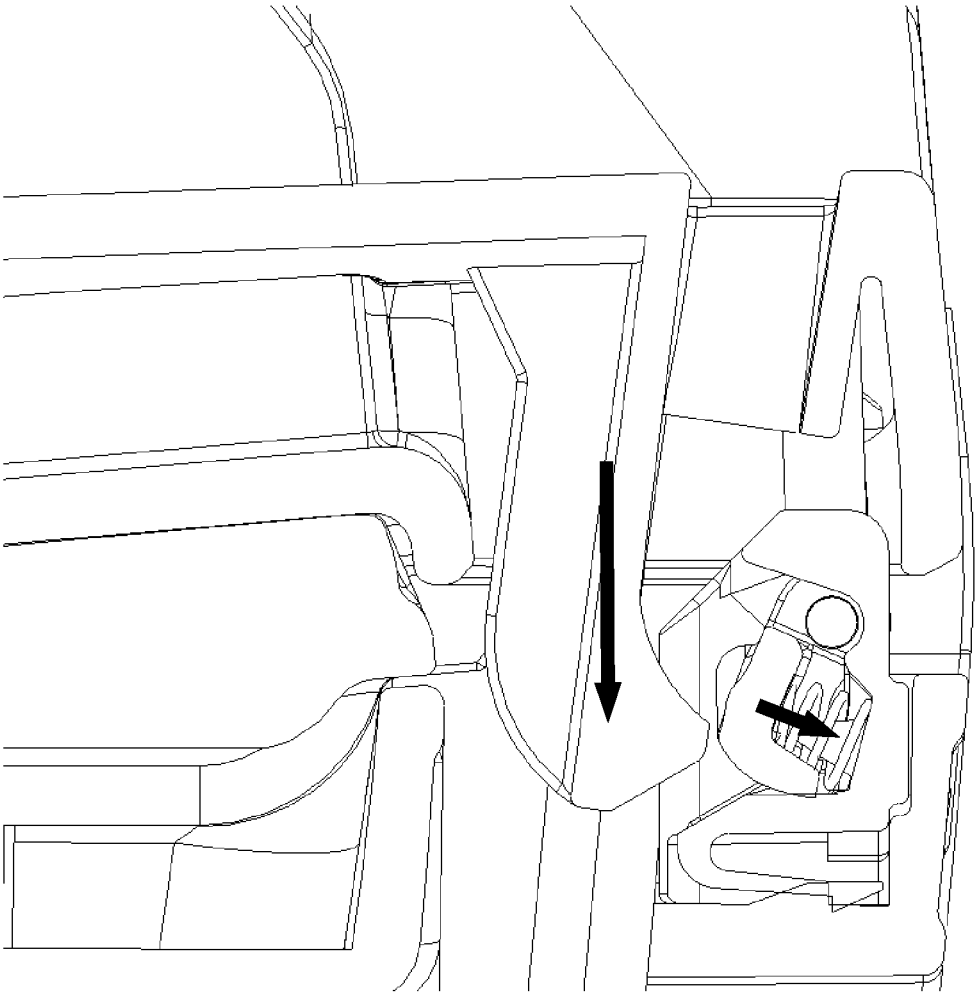
Figure 180:
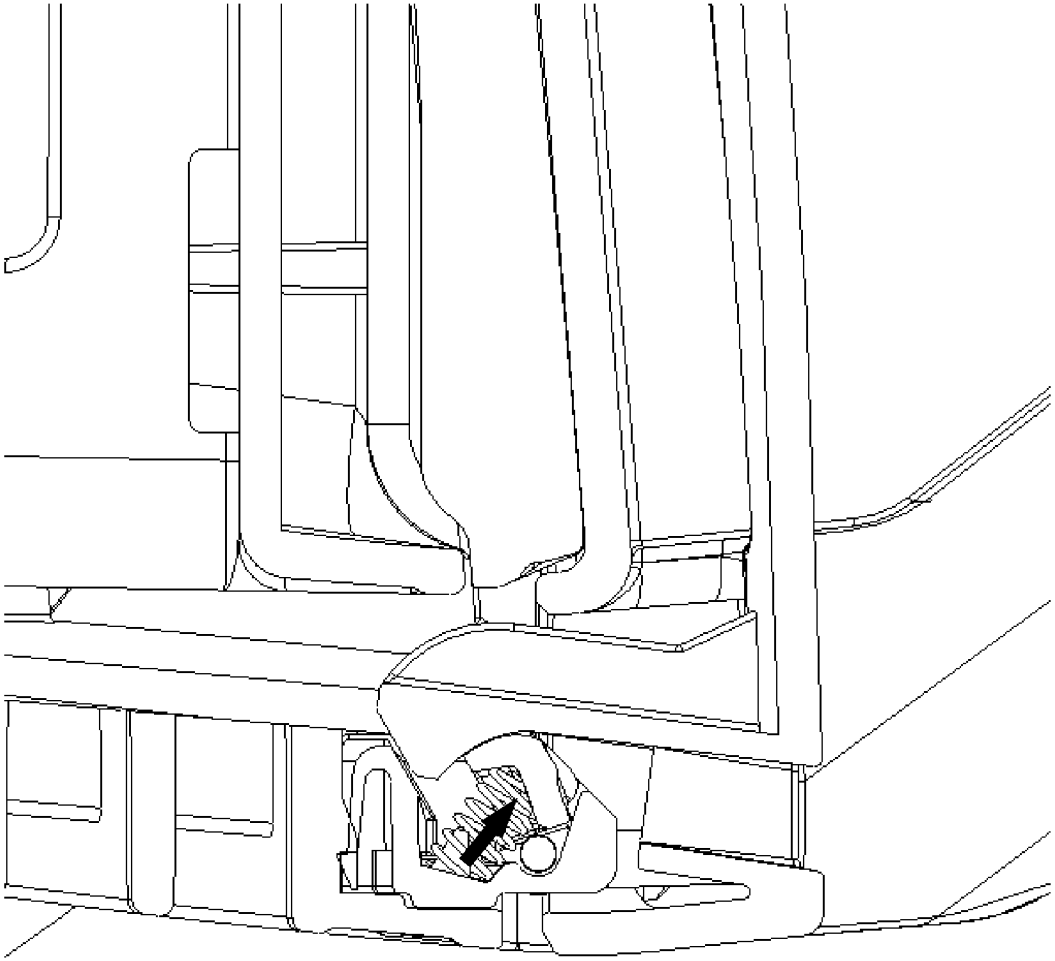

The canister post will push the spring loaded latch out of the way when it is returned to the pool cleaner's canister pocket FIG. 18N: Pivot Point FIG. 18O: Rear Canister Latch and Pivot—04

The rear latch spring loads into its locked position

Figure 18P:
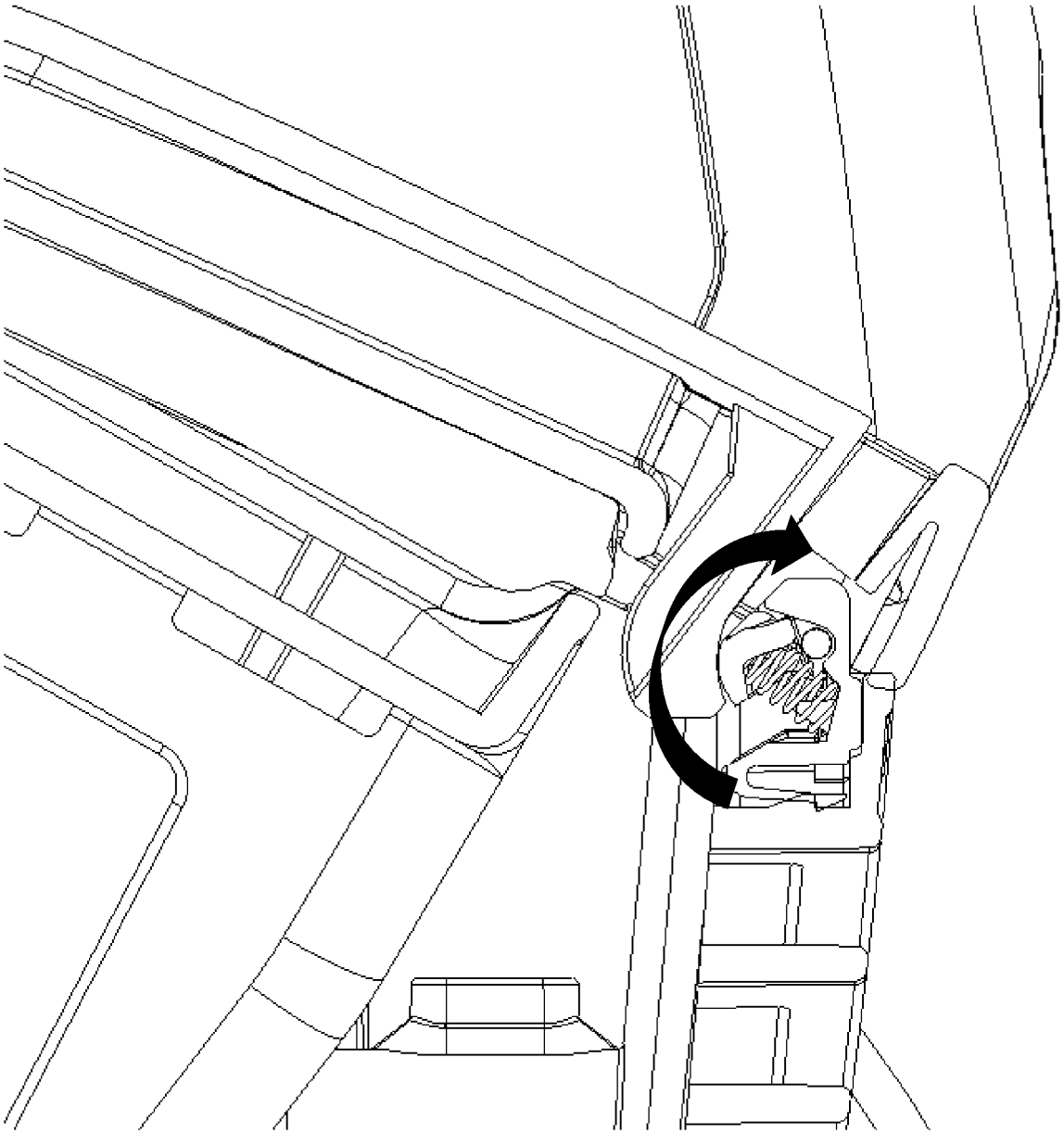
Figure 18Q:
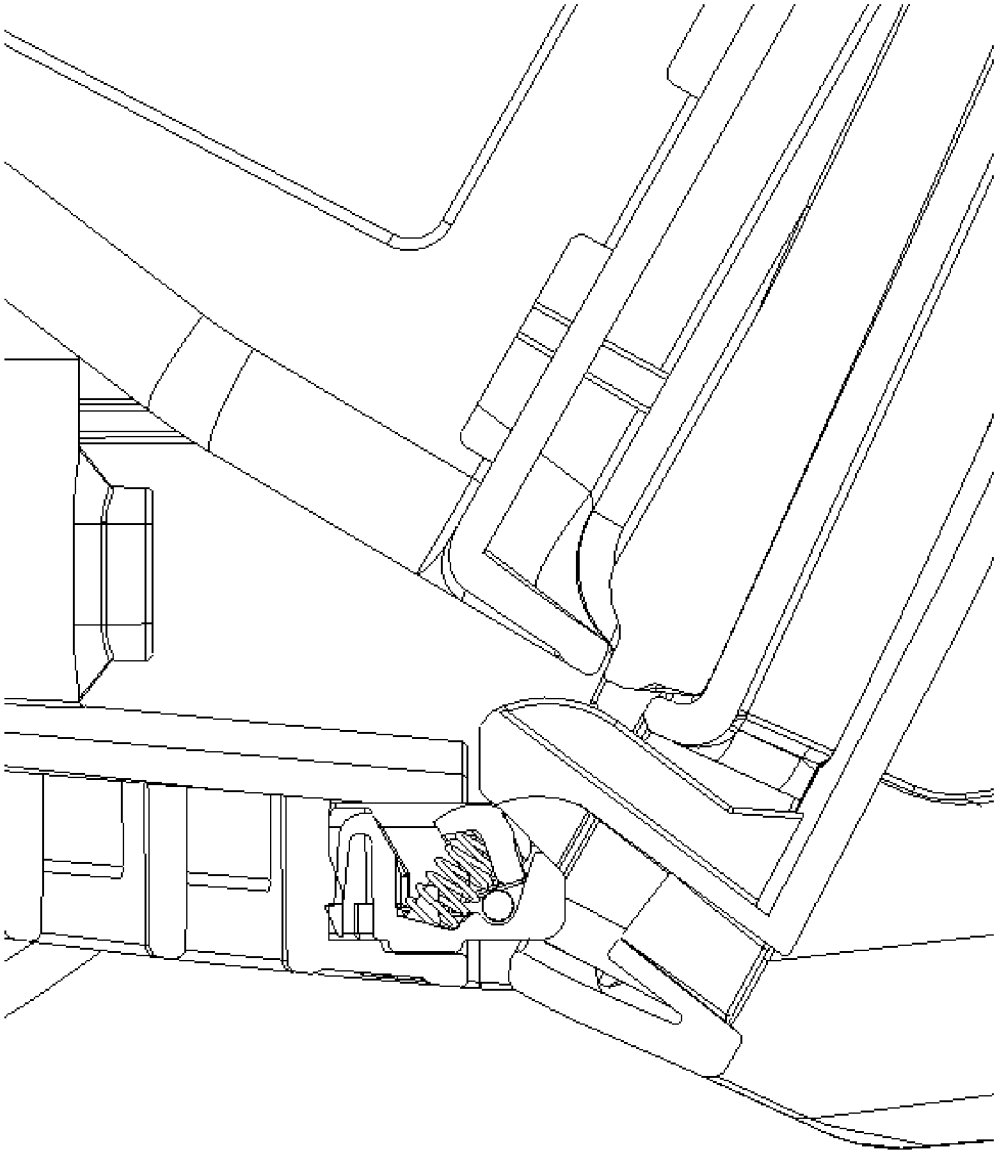

FIG. 18P: Rear Canister Latch and Pivot—05

During the canister's removal from the pool cleaner, the forward latch is disengaged and the canister pivots about the rear latch FIG. 18Q: Rear Canister Latch and Pivot—05

During the canister's removal from the pool cleaner, the forward latch is disengaged and the canister pivots about the rear latch FIG. 19A: 04—Idler Assembly highlighted in blue FIG. 19B: 05—Idler Assembly Idler gear transfer torque from the front wheel to the rear wheel but spins independently of the rest of the Idler Assembly. The Idler gear is mounted on a free spinning bearing The blue gear on Idler Assembly is driven by a gear in the Hydraulic Engine Hydraulic Engine Miter gears on the idler assembly drive the turbines on the bottom of the cleaner FIG. 19C: 06—Bottom View of Pool Cleaner Turbines are driven by the miter gears on the Idler Assembly The foregoing is provided for purposes of illustrating, explaining, and describing embodiments of the present invention. Modifications and adaptations to these embodiments will be apparent to those skilled in the art and may be made without departing from the scope or spirit of the invention. Additionally, the word "pool" and phrase "swimming pool" as used herein may include vessels such as spas and hot tubs within its definition, and "pressurized" water is water whose pressure is above that generally of the vessel in which the cleaner is positioned or operating. Finally, the entire contents of the Moore and Hui applications, the van der Meijden patent, and U.S. Patent Application Publication No. 2018/0066444 of van der Meij den, et al., are incorporated herein by this reference.

What is claimed is:

1. An automatic swimming pool cleaner comprising:

a. a body comprising (i) an inlet for debris-laden water of a pool and (ii) an outlet for filtered water;

b. at least one motive element for moving the body along a surface of the pool; and c. a filter assembly (i) configured to receive debris-laden water of the pool and exhaust filtered water, (ii) including a first filter comprising mesh having openings of a first size and a second filter comprising mesh having openings of a second size smaller than the first size, and (iii) defining a by-pass in which some water exiting the first filter bypasses the mesh of the second filter while flowing to the outlet.

2. An automatic swimming pool cleaner according to claim 1 in which (a) at least a majority of the first filter is removably fitted within the second filter and (b) the body defines a cavity into which the filter assembly is fitted in use.

3. An automatic swimming pool cleaner according to claim 1 in which (a) the filter assembly further includes an upper part and (b) the first and second filters form a lower part, the upper part and the lower part connecting to form a canister.

* * * * *